US008608134B2

(12) United States Patent
Drent et al.

(10) Patent No.: US 8,608,134 B2
(45) Date of Patent: Dec. 17, 2013

(54) CRANE HOOK BLOCK

(75) Inventors: Lambert Drent, Nieuw Buinen (NL); Dirk Albert Stamhuis, Stadskanaal (NL); William J. O'Neil, Green Bay, WI (US); Alan E. Pleuss, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 240 days.

(21) Appl. No.: 13/043,019

(22) Filed: Mar. 8, 2011

(65) Prior Publication Data

US 2011/0154642 A1 Jun. 30, 2011

Related U.S. Application Data

(63) Continuation of application No. 12/709,678, filed on Feb. 22, 2010, now Pat. No. 7,946,560.

(60) Provisional application No. 61/155,455, filed on Feb. 25, 2009.

(51) Int. Cl.
*B66D 3/08* (2006.01)

(52) U.S. Cl.
USPC ..... 254/393; 254/401; 294/82.11; 294/86.41

(58) Field of Classification Search
USPC ..... 254/393, 401; 294/82.1, 82.11, 82.15, 294/86.41
See application file for complete search history.

(56) References Cited

U.S. PATENT DOCUMENTS 1,379,868 A * 5/1921 Kelsey ..... 254/403
1,436,608 A * 11/1922 Rodier ..... 254/399

(Continued)

FOREIGN PATENT DOCUMENTS

| | | |
|---|---|---|
| CN | 101258095 A | 9/2008 |
| DE | 20 2005 01674 | 3/2007 |
| EP | 1 363 847 | 11/2003 |
| JP | 8-143266 | 6/1996 |

OTHER PUBLICATIONS

European Search Report for related EP Application No. 10250333.1, mailed Oct. 21, 2010 (10 pages).

(Continued)

*Primary Examiner* — William A Rivera
*Assistant Examiner* — Justin Stefanon
(74) *Attorney, Agent, or Firm* — Nathan O. Greene; Brinks Gilson & Lione

(57) ABSTRACT

A method of assembling a hook block for a crane includes: providing a sheave housing containing a plurality of sheaves with a pivotal connection link secured to the top of the sheave housing, the sheave housing including extended portions each with a hole therethrough and a housing frame positioned below the plurality of sheaves, the housing frame having a locking surface; placing a cross beam on its side, the cross beam having stabilizing feet resting on the ground; positioning the extended portions of the sheave housing within a plurality of brackets of the cross beam, each bracket with a hole therethrough; aligning the holes of the extended portions of the sheave housing with the holes of the brackets; inserting a shaft through the aligned holes; securing a cap to an end of the shaft to resist lateral movement relative to the holes; and inserting a locking bar between the locking surface of the housing frame and a surface of a bracket of the cross beam, to resist relative movement between the sheave housing and the cross beam during further assembly.

16 Claims, 23 Drawing Sheets

(56) References Cited

U.S. PATENT DOCUMENTS

| | | | | |
|---|---|---|---|---|
| 3,009,728 | A | 11/1961 | Breslav | |
| 4,153,123 | A | 5/1979 | Bereyziat | |
| 4,240,614 | A | 12/1980 | Comer, Jr. | |
| 4,721,286 | A * | 1/1988 | Hey et al. | 254/399 |
| 5,071,184 | A | 12/1991 | Dessaux | |
| 5,451,032 | A | 9/1995 | Rhoads | |
| 5,476,247 | A | 12/1995 | Melder | |
| 6,908,074 | B2 * | 6/2005 | Eiwan | 254/390 |
| 6,991,275 | B2 * | 1/2006 | Zollondz et al. | 294/82.15 |
| 7,469,882 | B2 * | 12/2008 | Frommelt | 254/393 |
| 7,722,013 | B2 | 5/2010 | Franzen et al. | |
| 2004/0084917 | A1 * | 5/2004 | Zollondz et al. | 294/82.15 |
| 2004/0183061 | A1 | 9/2004 | Winter et al. | |
| 2007/0290182 | A1 * | 12/2007 | Noeske et al. | 254/327 |
| 2009/0267039 | A1 * | 10/2009 | Franzen et al. | 254/401 |
| 2010/0237641 | A1 | 9/2010 | Drent et al. | |

OTHER PUBLICATIONS

European Partial Search Report for related EP Application No. 12168103.5, mailed Oct. 17, 2012 (7 pages).

First Office Action in corresponding application CN201010148467.2 , issued Jul. 19, 2013, 3 pages.

* cited by examiner

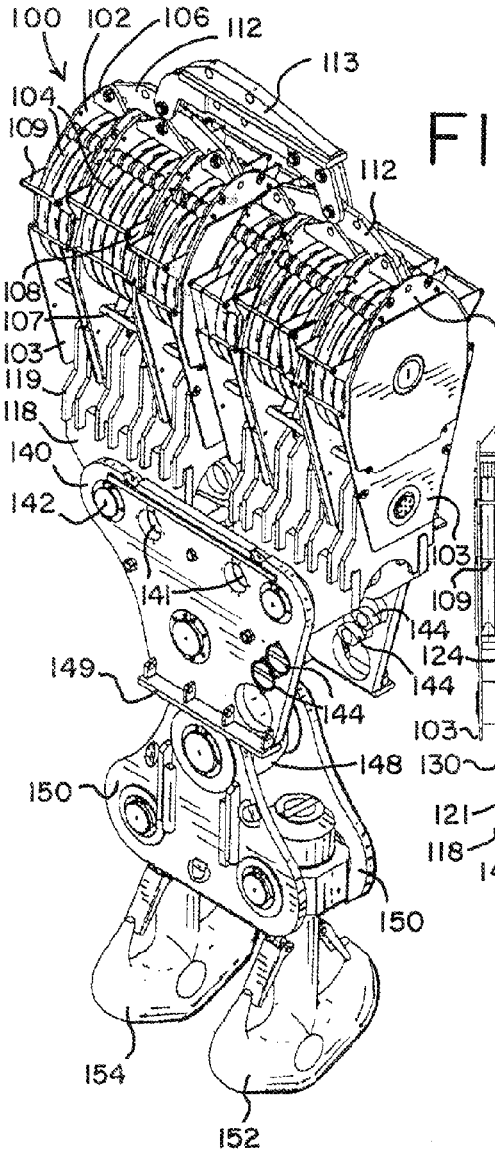
FIG. 2
FIG. 3
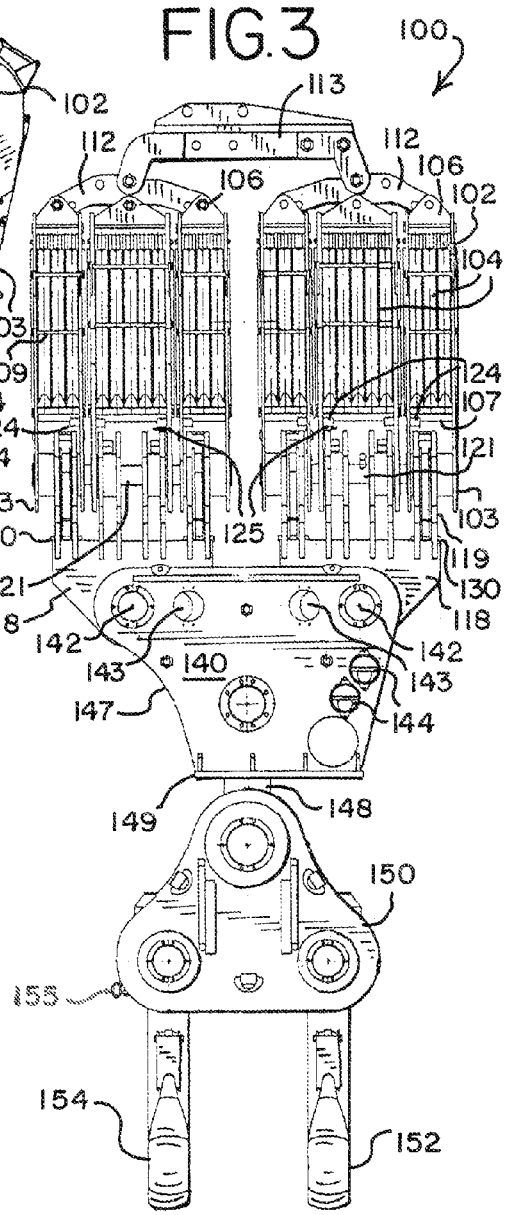

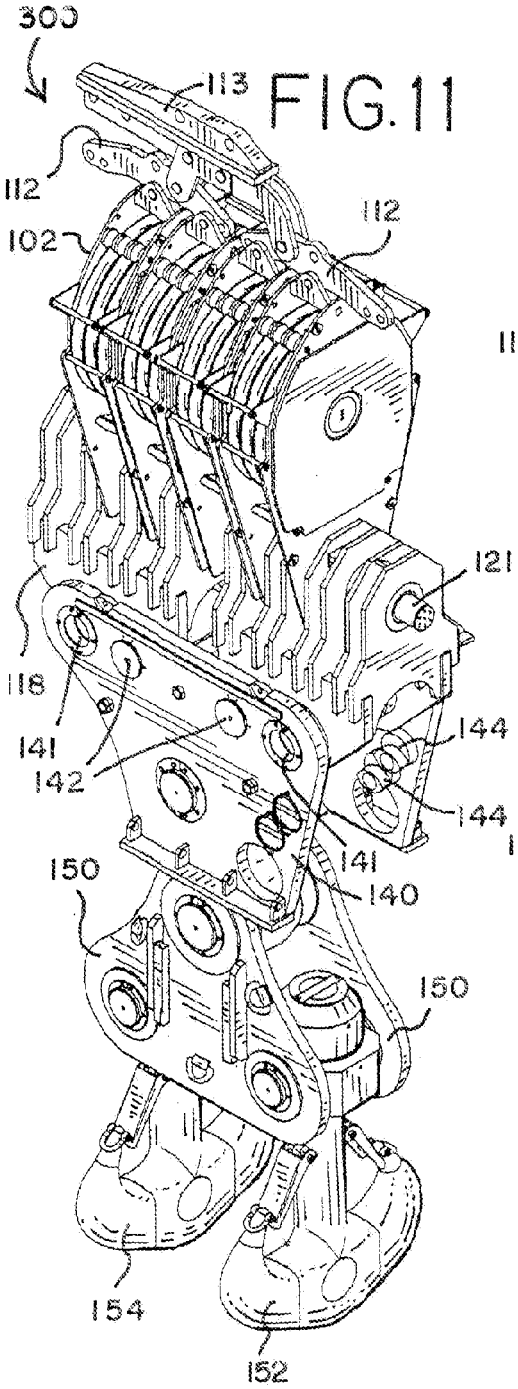
FIG.11
FIG.12
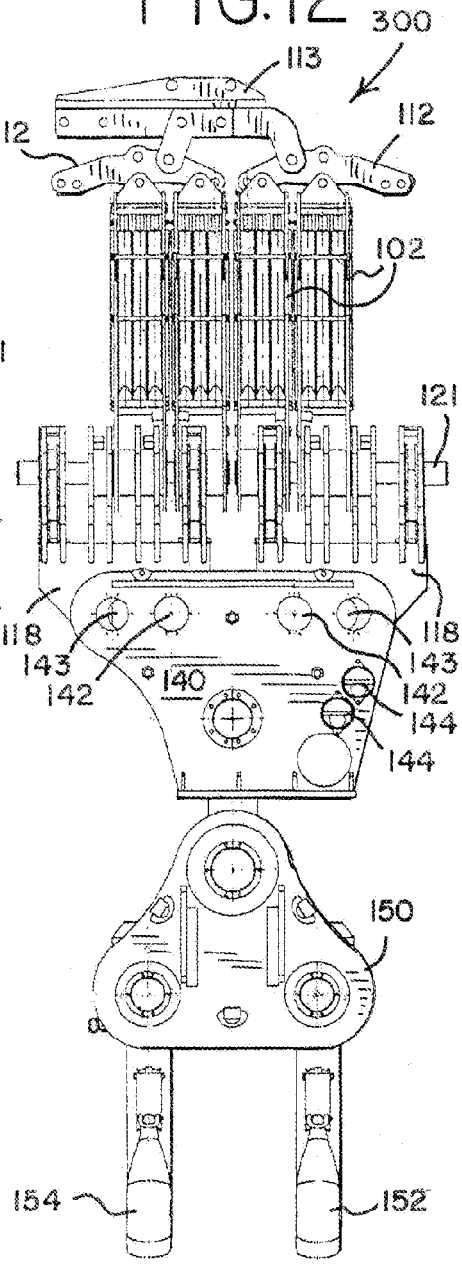

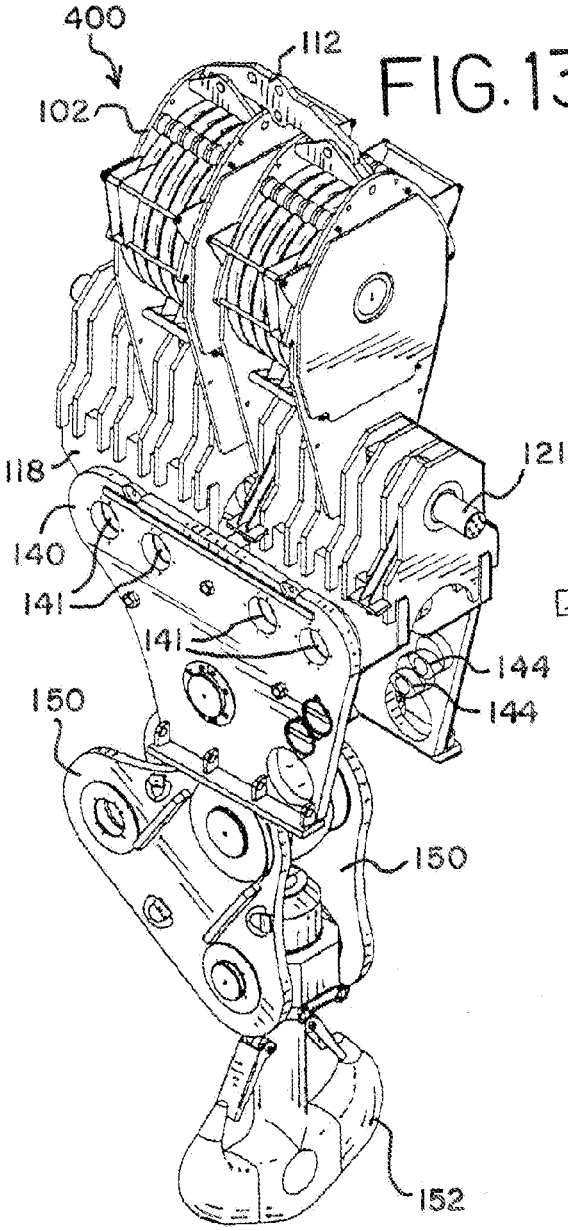
FIG. 13
FIG. 14
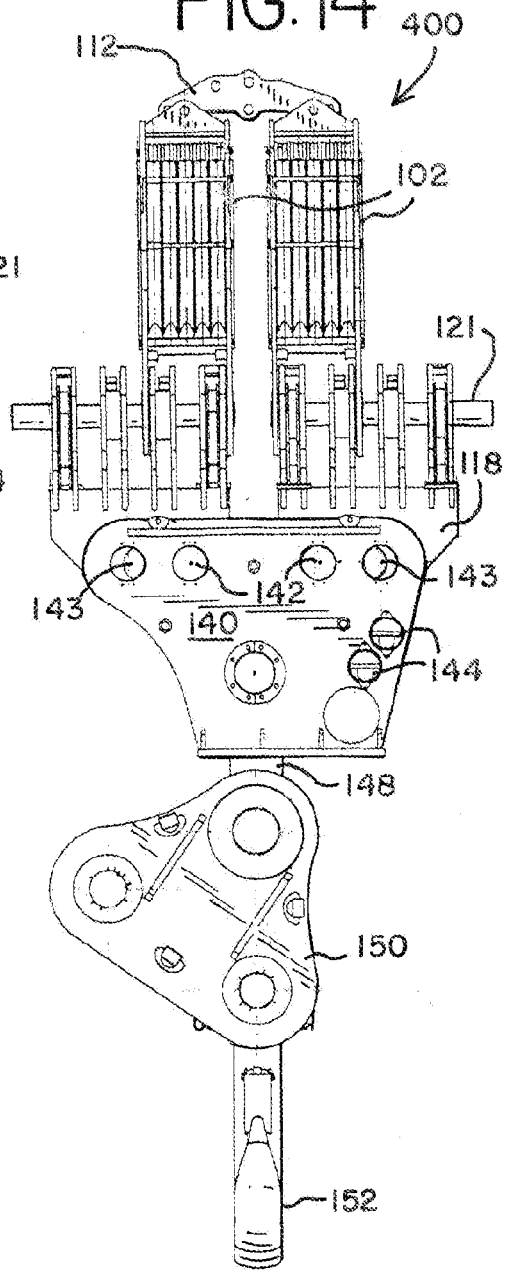

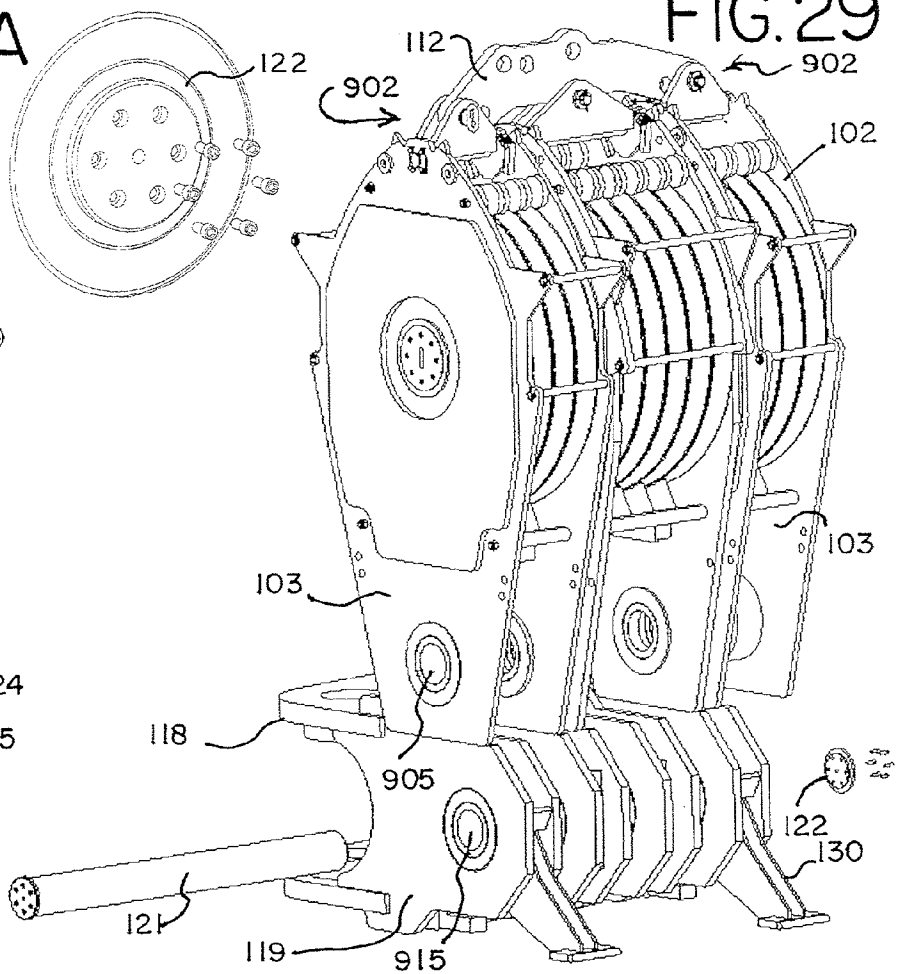
FIG. 29
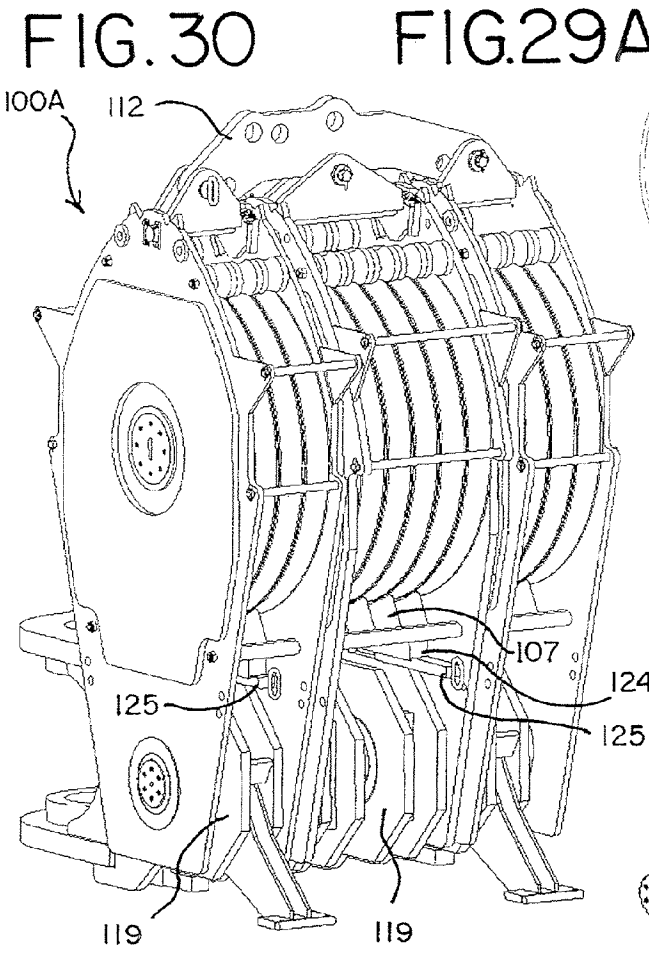
FIG. 29A
FIG. 30

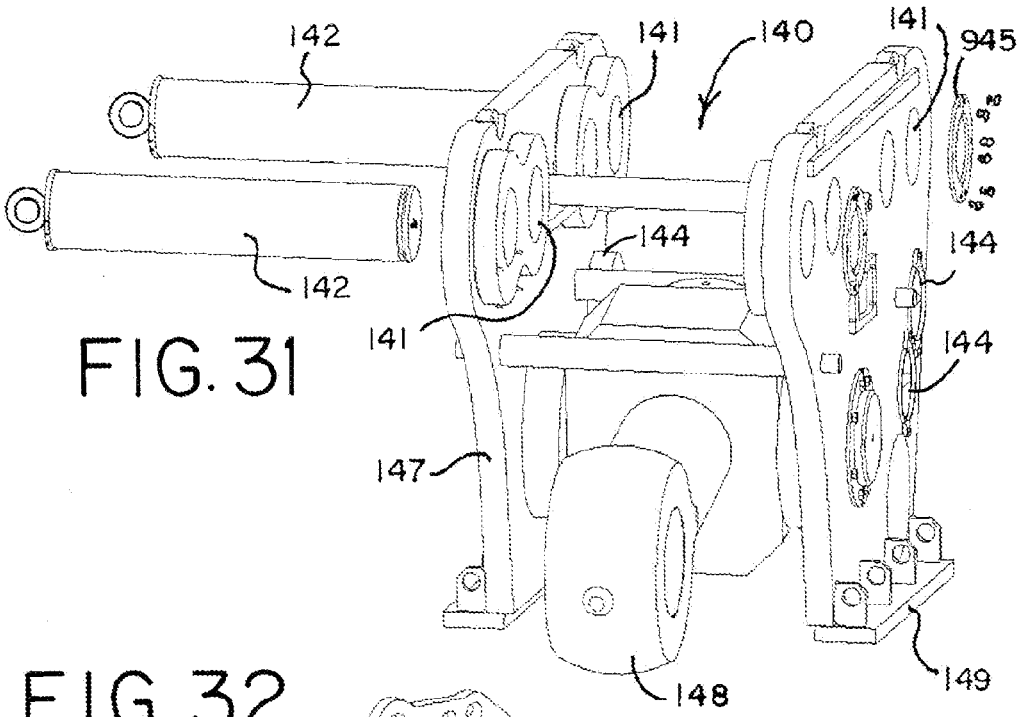
FIG. 31
FIG. 32
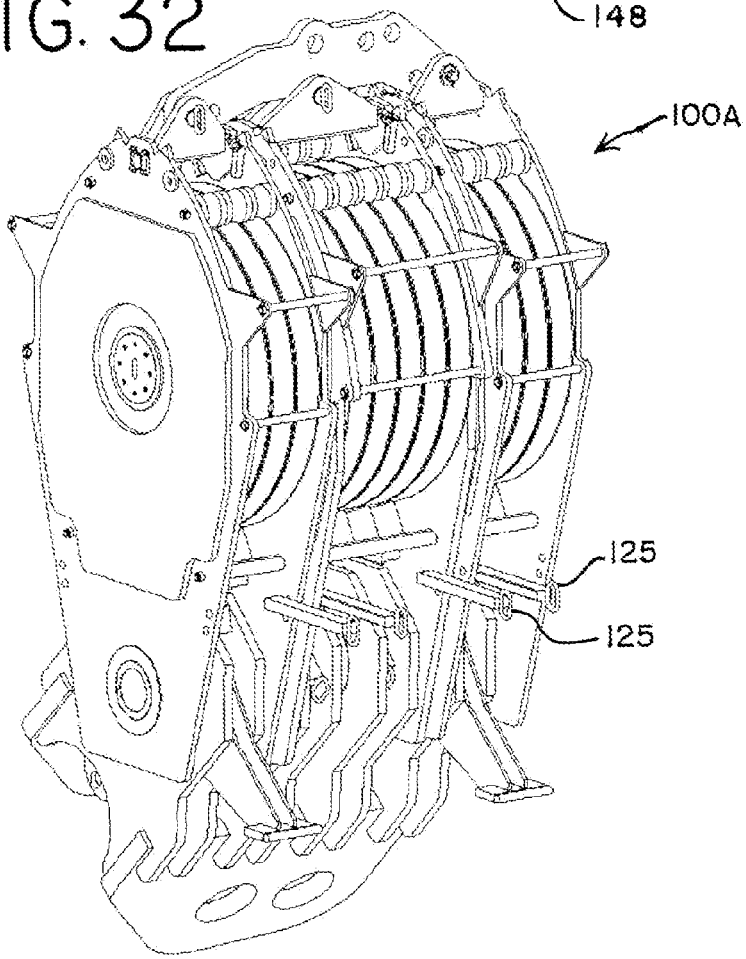

CRANE HOOK BLOCK

REFERENCE TO EARLIER FILED APPLICATION

The present application is a continuing application of U.S. patent application Ser. No. 12/709,678, filed Feb. 22, 2010, which claims the benefit of the filing date under 35 U.S.C. §119(e) of Provisional U.S. Patent Application Ser. No. 61/155,455, filed Feb. 25, 2009, both of which are hereby incorporated by this reference.

BACKGROUND

The present application relates to hook blocks that are used at the end of one or more wire ropes of a crane boom or luffing jib to lift heavy loads. More specifically, the present application relates to a hook block assembly capable of being assembled with different numbers and types of components to assemble different hook blocks customized for different loads. The various embodiments disclosed herein include improvements that facilitate reeving wire rope through the sheaves of the hook block by helping to immobilize and stabilize pieces that normally move during lifting operation.

The hook block acts as a block and tackle, and more specifically, as a compound pulley system because of the multiple sheaves used. Pulleys are used to change the direction of an applied force, transmit rotation motion, or realize a mechanical advantage in either a linear or rotational system of motion. A wire rope is used with a crane hook block because wire rope can withstand great tension under heavy loads. Sets of sheaves are located within housings of the hook block. Sheaves are wheels having a groove between two flanges around the circumference of the wheel.

In equilibrium, the total force on a basic pulley is zero. This means that the force on the axle of the pulley is shared equally by the two lines looping through the pulley. For the case where the lines are not parallel, the tensions in each line are still equal, but now the vector sum of all forces is zero. A second basic equation for the basic pulley follows from the conservation of energy: the product of the weight lifted times the distance it is moved is equal to the product of the lifting force (the tension in the lifting line) times the distance the lifting line is moved. The weight lifted divided by the lifting force is the advantage of the pulley system. Note that a system of pulleys does not change the amount of work done. The work is given by the force times the distance moved. The pulley simply allows trading force for distance: you pull with less force, but over a longer distance.

The term reeve means to pass a rope through a hole, ring, pulley, or block. In order to reeve the sheaves of a hook block, the hook block is often placed in an upright standing position, laid down horizontally, or in some cases it can be laid back over against the hook holding it up at some angle. Any maneuvering of the hook block is typically done with lifting equipment because, when fully assembled, a larger hook block can weigh over a hundred thousand pounds (over fifty thousand kilograms). If the hook block is horizontal, then it may be difficult and dangerous to handle the wire rope underneath the block. The favored orientation can depend on whether the boom top of the crane is positioned directly over the block or a short distance away from it horizontally.

Reeving is then done by passing the wire rope from one side of the block around a sheave to the other side of the block, and then around a sheave in the boom top, and so on until reeving through all of the desired sheaves is complete. Reeving the hook block is made easier when the sheaves are within reach of a person standing on the ground. Care needs to be taken during reeving not to pull too hard on the ropes, or at an angle, to prevent the block from tipping over. Care should also be taken not to let the wire rope rub against any fixed edges like those of plates, tie bolts, or cross bars that could damage the wire rope.

BRIEF DESCRIPTION OF THE DRAWINGS

FIG. 2 is a perspective view of a hook block according to the present disclosure.

FIG. 3 is a front elevation view of the hook block of FIG. 2.

FIG. 11 is a perspective view an alternative embodiment of the hook block of FIG. 2, using four three-sheave housings.

FIG. 12 is a front elevation view of the hook block of FIG. 11.

FIG. 13 is perspective view of an alternative embodiment of the hook block of FIG. 2, using two five-sheave housings.

FIG. 14 is a front elevation view of the hook block of FIG. 13.

FIG. 25 through FIG. 46 are perspective views of the hook block of FIG. 2, displaying step-by-step assembly thereof, wherein FIG. 25 displays a set of sheave housing assemblies.

FIG. 26 is a perspective view of a connection link connected to each of the sheave housings of FIG. 25.

FIG. 27 is a partially-exploded view of connecting a connection beam to the connection links of FIG. 25.

FIG. 28 is an exploded view of a cross beam and shaft for assembling the hook block of FIG. 2, the cross beam including stabilizing feet.

FIG. 29 is a partially-exploded view of how the shaft is rotatably captured within the cross beam and the sheave housing assemblies of FIG. 25.

FIG. 29A is a perspective view of securing a cap to the shaft of FIG. 29, to prevent dislodging the shaft after assembly.

FIG. 30 is a perspective view of the partially-assembled hook block of FIG. 29, displaying insertion of locking bars between a housing frame of the sheave housings and brackets of the cross beam.

FIG. 31 is a partially-exploded view of the equalizer beam of the hook block of FIG. 2.

FIG. 32 is a perspective view of the partially-assembled hook block of FIG. 30 being lifted into the air and the locking bars removed.

FIG. 33 is a perspective view of the partially-assembled hook block of FIG. 32, being lowered between plates of the equalizer beam of FIG. 31.

FIG. 34 is a perspective view of pivotally connecting the cross beam to the equalizer beam of the partially-assembled hook block of FIG. 33, and a securing pin inserted between the cross beam and the equalizer beam to lock them from relative movement.

FIG. 35 is a perspective view of the partially-assembled hook block of FIG. 34 after repetition of the steps of FIGS. 25 through 34 to connect another set of sheave housing assemblies to the other side of the equalizer beam.

FIG. 36 is a perspective view of attaching a main connection beam to the connection beams of each sheave housing assembly of the partially-assembled hook block of FIG. 35, including removal of the locking bars.

FIG. 37 is a perspective view of the partially-assembled hook block of FIG. 36 being tilted over to a laying position.

FIG. 38 is a perspective view of the partially-assembled hook block of FIG. 37 with the equalizer beam and cross beam laying on the ground, the sheave housing assemblies being at a 90° angle to the cross beam and stabilized with the stabilizing feet.

FIG. 39 is a perspective view of the partially-assembled hook block of FIG. 38, after the sheave housing assemblies are locked into a 45° angle with respect to the ground with locking bars, ready for reeving, wherein the boom top is above the hook block.

FIG. 40 is a perspective view of the partially-assembled hook block of FIG. 39 after the connection beams at the top of the sheave housing assemblies are rotated to the side, toward the ground, in preparation for reeving, wherein the boom top is to the side of the hook block.

FIG. 41 is a perspective view of the partially-assembled hook block of FIG. 40 after reeving, in which the connection beams have been rotated back up and the locking bars removed. (The wire rope is not shown for sake of clarity.)

FIG. 42 is a perspective view of the partially-assembled hook block of FIG. 41 being slowly lifted to a vertical position.

FIG. 43 is a perspective view of the partially-assembled hook block of FIG. 42 in an upright position, the equalizer beam standing on the ground after removal of the securing pins, the partially-assembled hook block ready to lifted into operation.

FIG. 44 is a perspective view of the partially-assembled hook block of FIG. 43 after being lifted into the air, a main eye of the equalizer beam being rotatably connected to a hook suspension.

FIG. 45 is a perspective view of the partially-assembled hook block of FIG. 44 with the hook suspension rotatably connected to the main eye.

FIG. 46 is a perspective view of the assembled hook block of FIG. 2 after being assembled according to FIGS. 25 through 45, and ready for operation.

DETAILED DESCRIPTION OF THE DRAWINGS AND THE PRESENTLY PREFERRED EMBODIMENTS

The present embodiments will now be further described. In the following passages, different aspects of the embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
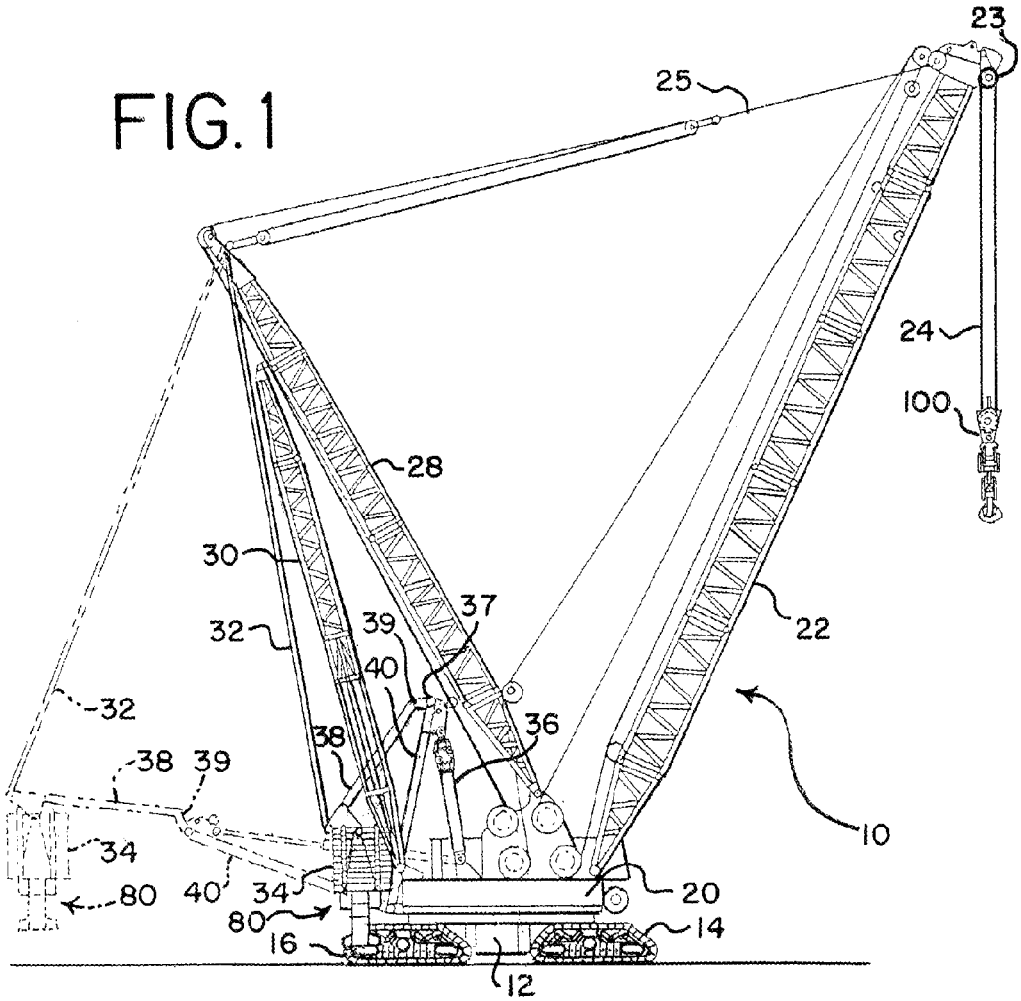
FIG. 1 is a side elevational view of a mobile lift crane with counterweights according to the present disclosure.

While the embodiments of the hook block and associated assemblies will have applicability to hook blocks used on other cranes or machinery, it will be described in connection with a mobile lift crane 10, shown in FIG. 1. The mobile lift crane 10 includes lower works, also referred to as a carbody 12, and moveable ground engaging members in the form of crawlers 14 and 16. There are two front crawlers 14 and two rear crawlers 16, only one each of which can be seen from the side view of FIG. 1. In the crane 10, the ground engaging members could be just one set of crawlers, one crawler on each side.

A rotating bed 20 is rotatably connected to the carbody 12 such that the rotating bed can swing with respect to the ground engaging members. The rotating bed is mounted to the carbody 12 with a slewing ring, such that the rotating bed 20 can swing about an axis with respect to the ground engaging members 14, 16. The rotating bed supports a boom 22 pivotally mounted on a front portion of the rotating bed; a sheave block 23 at the boom top including sheaves; a mast 28 mounted at its first end on the rotating bed 20; a backhitch 30 connected between the mast and a rear portion of the rotating bed; and a moveable counterweight unit 34 having counterweights on a support member.

Boom hoist rigging 25 between the top of mast 28 and boom 22 is used to control the boom angle and transfers load so that the counterweight can be used to balance a load lifted by the crane 10. A load hoist line 24, also referred to herein as wire rope 24, extends from the boom 22, supporting a hook book 100 designed for lifting heavy loads.

The load hoist line 24 passes through the sheave block 23 at the top of the boom 22, and then through the hook block 100. As the hoist line 24 is eventually connected to the rotating bed 20, when the boom 22 booms down (or is lowered), the hook block 100 will be pulled towards the boom end as the hoist line 24 effectively shortens. A "two-block condition" may occur if the hook block runs into the sheave block 23, snapping the hoist line 24, and causing the load to drop. This can be prevented by spooling out wire rope (or cable) fast enough to match the extending boom 22. The crane 10 may include mechanical sensors that alert the operator if the two-block condition is imminent, referred to as anti-two-block The rotating bed 20 may also include other elements commonly found on a mobile lift crane, such as an operator's cab and hoist drums for the rigging 25 and hoist line 24. If desired, the boom 22 may include a luffing jib pivotally mounted to the top of the main boom, or other boom configurations. The backhitch 30 is connected adjacent the top of the mast 28, but down the mast far enough that it does not interfere with other items connected to the mast. The backhitch 30 may comprise a lattice member designed to carry both compression and tension loads as shown in FIG. 1. In the crane 10, the mast 28 is held at a fixed angle with respect to the rotating bed during crane operations, such as a pick, move and set operation.

The counterweight unit 34 is moveable with respect to the rest of the rotating bed 20. A tension member 32 connected adjacent the top of the mast supports the counterweight unit in a suspended mode. A counterweight movement structure is connected between the rotating bed 20 and the counterweight unit 34 such that the counterweight unit 34 may be moved to and held at a first position in front of the top of the mast, and moved to and held at a second position rearward of the top of the mast.

At least one linear actuation device, in this embodiment a rack and pinion assembly 36, and at least one arm pivotally connected at a first end to the rotating bed and at a second end to the a rack and pinion assembly 36, are used in the counterweight movement structure of crane 10 to change the position of the counterweight unit 34. The arm and a rack and pinion assembly 36 are connected between the rotating bed and the counterweight unit 34 such that extension and retraction of the rack and pinion assembly 36 changes the position of the counterweight unit 34 compared to the rotating bed 20. FIG. 1 shows the counterweight unit 34 in its most forward position in solid lines and at its farthest back position in dotted lines. The rack and pinion assembly 36 moves the counterweight unit 34 to a mid position, such as when a load is suspended from the hook 26.

The pivot frame 40, a solid welded plate structure, is connected between the rotating bed 20 and the second end of the rack and pinion assembly 36. The rear arm 38 is connected between the pivot frame 40 and the counterweight unit 34. A set of pins 37 are used to connect the rear arm 38 and the pivot frame 40. The rear arm 38 is also a welded plate structure with an angled portion 39 at the end that connects to the pivot frame 40. This allows the arm 38 to connect directly in line with the pivot frame 40.

The crane 10 is equipped with a counterweight support system 80, which may be required to comply with crane regulations in some countries. Because the counterweight unit 34 can move far forward with respect to the front of the rotating bed, the counterweight supports on the support system 80 may interfere with swing operations unless they are sufficiently spaced apart. This, however, makes the support structure itself very wide. The crane 10 thus uses a counterweight support structure attached to the counterweight unit 34 that includes a telescoping counterweight support system 80. The counterweight unit 34 is constructed so that the counterweight support system 80 can be removed and the crane can function both with and without it.

The preferred embodiment of the present invention relates to a high capacity mobile lift crane, other aspects of which are disclosed in U.S. Pat. No. 7,546,928 and the following co-pending United States patent applications assigned to the assignee of the present application: "Mobile Lift Crane With Variable Position Counterweight," Ser. No. 12/023,902, filed Jan. 31, 2008, "Mast Raising Structure And Process For High-Capacity Mobile Lift Crane," Ser. No. 11/740,726, filed Apr. 26, 2007, "Connection System For Crane Boom Segments," Ser. No. 12/273,310, filed Nov. 18, 2008, "Drive Tumbler And Track Drive For Mobile Vehicles, Including Lift Cranes," Ser. No. 12/368,143, filed Feb. 9, 2009, "Track Connection System For Mobile Vehicles, Including Lift Cranes," Ser. No. 12/368,125, filed Feb. 9, 2009, "Track Tensioning System For Mobile Vehicles, Including Lift Cranes," Ser. No. 12/368,113, filed Feb. 9, 2009, "Boom Hoist Transportation System And Crane Using Same," Ser. No. 12/561,007, filed Sep. 16, 2009, Carbody Connection System And Crane Using Same," Ser. No. 12/561,103, filed Sep. 16, 2009, "Trunnion Transportation System And Crane Using Same," Ser. No. 12/561,058, filed Sep. 16, 2009, "Drum Frame System For Cranes," Ser. No. 12/561,094, filed Sep. 16, 2009, Swing Drive System For Cranes," Ser. No. 12/710,960, filed Feb. 23, 2010, "Counterweight Block And Assemblies For Cranes," Ser. No. 61/158,599, filed Mar. 9, 2009, "Folding Jib Main Strut And Transportable Reeved Strut Caps," Ser. No. 61/165,403, filed Mar. 31, 2009, "Crane Boom Stop," Ser. No. 61/179,935, filed May 20, 2009, and "Crane Backstay Spreader," Ser. No. 61/179,983, filed May 20, 2009. Each of these applications is hereby incorporated by reference.

One of the benefits of the present embodiments is that several different hook blocks can all be made out of the same set of hook block components. When a crane is sold it includes all of the components needed to make a hook block used to lift the maximum rated load capacity of the crane. Realizing, however, that the crane will not always be used to lift such large loads, it is beneficial that the hook block components can be assembled to make hook blocks for lifting smaller loads.

In the present embodiments, one set of components can be used to make six different hook block configurations. All of those components are used in the hook block 100 shown in FIGS. 1-4. Those components include: four three-sheave housings and two five-sheave housings 102; two connection beams 112; a main connection beam 113; one each of right and left cross beams 118; two shafts 121; an equalizer beam 140; two hook suspension sideplates 150; a hook suspension 152 without locking, and a hook suspension 154 with locking. Table 1, below, shows these components listed in the left column of the table.

The other hook block arrangements that can be made from these same components and the figures of the application that show that hook block are listed across the top of Table 1. Embodiments 200-600 are additional assemblies made from the same components as hook block 100, as will be discussed in detail with reference to FIGS. 9-16. Two other hook block embodiments (700 and 800) use mostly components used in hook block 100, but also include a few specialty components not used in hook block 100 (listed in Table 1), as will be discussed with reference to FIGS. 17-18 and 21-24, respectively.

TABLE 1

| Ref. No. | | Hook Block Embodiment 100 | 200 | 300 | 400 | 500 | 600 | 700 | 800 |
|---|---|---|---|---|---|---|---|---|---|
| | | Figure(s) 2-4 | 9-10 | 11-12 | 13-14 | 15 | 16 | 17-18 | 21-24 |
| 102 | three-sheave housing | 4 | 2 | 4 | | 2 | | | |
| 102 | five-sheave housing | 2 | 2 | | 2 | | 1 | 1 | 1 |
| 112 | connection beam | 2 | 2 | 2 | 1 | 1 | | | |
| 113 | main connection beam | 1 | 1 | 1 | | | | | |
| 118 | right cross beam | 1 | 1 | 1 | 1 | 1 | 1 | | |
| 118 | left cross beam | 1 | 1 | 1 | 1 | | | | |
| 121 | shaft | 2 | 2 | 2 | 2 | 1 | | | |
| 140 | equalizer beam | 1 | 1 | 1 | 1 | 1 | 1 | | |
| 150 | hook suspension sideplates | 2 | 2 | 2 | 2 | 2 | 2 | 2 | |
| 152 | hook suspension without locking | 1 | 1 | 1 | 1 | 1 | 1 | | |
| 154 | hook suspension with locking | 1 | 1 | 1 | | | | 1 | 1 |
| 718 | link plate shaft | | | | | | | 1 | 1 |
| 740 | link plate | | | | | | | 1 | 1 |
| 850 | connection plates | | | | | | | | 2 |

Figure 4:
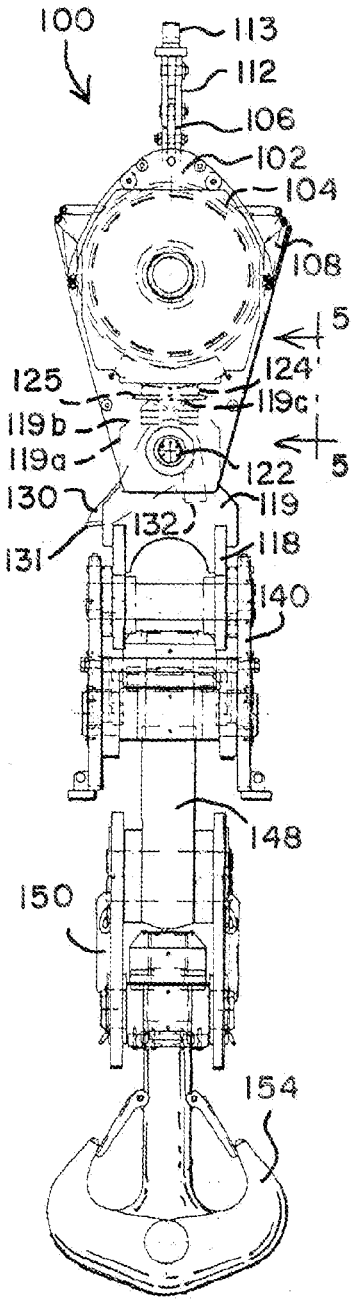
FIG. 4 is a side view of the hook block of FIG. 2.

Accordingly, the components in Table 1 may be variably integrated into the assembly of different hook block assemblies that allow for reducing the weight of each hook block for varying loads. For instance, the hook block 100 depicted in FIGS. 2-4 is configured to lift a load up to 2,000 metric tonne. With assembly of hook blocks 300, 500, or 600 for use on the main boom 22, enough components remain to assemble hook block 800 for simultaneous use on a luffing jib or on another crane, for instance. The assembly of the components of Table 1 may further differ from embodiments 100-800, and thus make up additional hook block embodiments not specifically recited herein, as would be apparent to one of ordinary skill in the art.

More specifically, the hook block 100 includes six sheave housings 102, each including extended portions 103 and containing a certain number of sheaves 104. There are two sheave housing subassemblies (100A in FIGS. 19-20), each including two three-sheave housings 102 and one five-sheave housing 102. As best seen in FIG. 3, each sheave housing subassembly forms half of the hook block 100. Each sheave housing subassembly can be individually assembled as will be discussed in more detail beginning with FIG. 25.

A connection link 106 is pivotally connected between sides and at the top of each sheave housing 102. A housing frame 107 is connected to the bottom of each sheave housing 102, below the sheaves 104 such that a wire rope has sufficient room to circumnavigate the sheaves 104. The housing frame 107 is semicircular to conform to the circular sheaves 104. The sheave housings 102 also include triangular brackets 108 through which are run stainless-steel pins 109. An anti-two-block device, discussed above, may then be mounted over the stainless-steel pins.

The connection beam 112 is attached to the respective connection links 106 of each sheave housing 102 when more than one is used. A number of holes are formed through the connection beam 112 through which bolts and nuts may secure it to respective holes on each connection link 112. Note that in this embodiment 100, a connection beam is used for three sheave housings 102, two of which have three sheaves and the middle of which has five sheaves.

The connection beam 112 may have holes formed sufficient in number and in proper locations to adapt to being attached to different numbers of sheave housings 102 having a varying number of sheaves 104. A main connection beam 113 is connected to two connection beams 112 when a sufficient number of sheave housings are employed in a single hook block, such as those displayed in FIGS. 1-2 and 9-10, for instance. The main connection beam 113 helps to keep the sheave housings properly spaced and aligned generally parallel to each other so that the forces are properly distributed at the top of the hook block 100. The main connection beam 113 also acts as a lifting point for the hook block 100 during assembly and reeving. In embodiments discussed below that use only the connection beam 112, it may also be used as a lifting point.

The extended portions 103 of the sheave housings 102 have formed therein holes toward the bottom thereof. The hook block 100 also includes two cross beams 118 (one right and the other left), each including multiple brackets 119 welded onto the top thereof. Each bracket 119 has a hole at its distal end, which holes correspond to the holes at the bottom of the extended portions 103, which are interspersed among the brackets 119 when their respective holes are aligned (FIG. 29). A shaft 121 is rotatably captured within the holes of both the extended portions 103 of the sheave housings and the brackets 119 of the cross beams 118. A cap 122 having smaller holes therethrough is provided to secure each end of the shaft 121 from slipping out from within the hook block 100.

Figure 6:
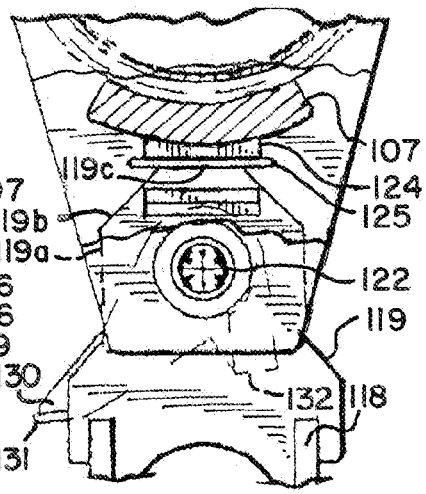
FIG. 6 is an enlarged cross section view of a locking bar inserted between a housing frame and a surface of a bracket of a cross beam of the hook block of FIG. 4.

Each bracket 119 is formed with multiple surfaces about its distal hole that are preferably flat. Each surface corresponds to an angle of relative position between the sheave housing 102 and the cross beam 118. As seen in FIGS. 4 and 6, surface 119*a* corresponds to 90°, surface 119*b* corresponds to 45°, and surface 119*c* corresponds to 0° with respect to the sheave housing 102. A cross bar 124 is attached to the bottom of the housing frame 107 that is curved on one side to mate along the bottom surface of the housing frame 107. A gap is formed between the cross bar 124 and each of the surfaces 119*a*, 119*b*, 119*c*, of the bracket 119. While the disclosed embodiment includes an attached cross bar 124, the frame housing 107 may also be molded as a single piece to include a locking surface such as provided by the cross bar 124.

Figure 5:
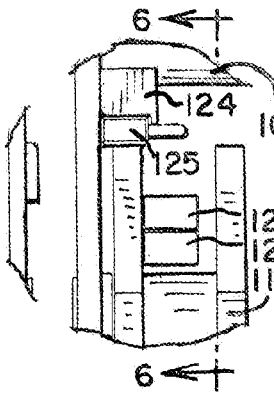
FIG. 5 is a front view of the locking bar of F*igure* 4 in locking position.
Figure 7:
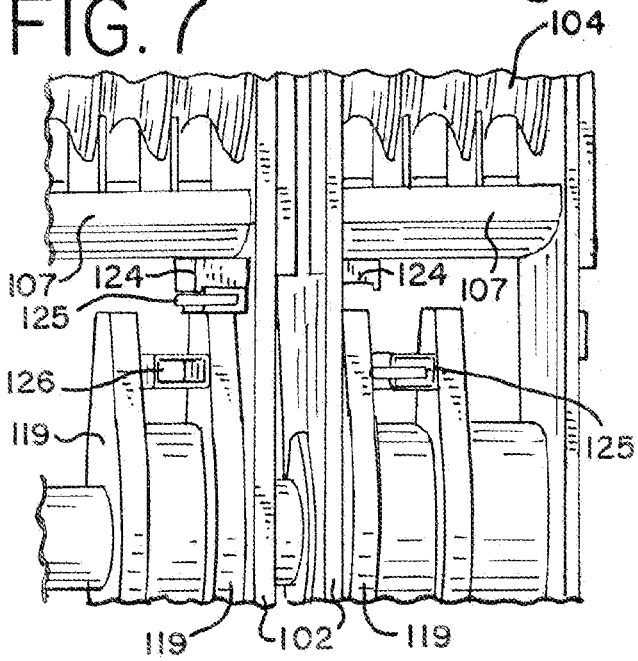
FIG. 7 is a front perspective view of the bottom of two sheave housings of the hook block of FIG. 2, wherein the locking bar on the left is employed and the locking bar on the right is stowed.

FIG. 5 shows the locking bar 125 of FIG. 5 in locking position. Along at least one of the brackets 119, one or more storage chambers 126 may be attached where the locking bar 125 can be stowed while not in use. FIG. 7 shows the bottom of two adjacent sheave housings 102, wherein the locking bar 125 of the left is employed and the locking bar 125 of the right is stowed. With further reference to FIG. 3, the three-sheave housings 102 include one cross bar 124 and one locking bar 125 each, while the five-sheave housings 102 include two each, to provide additional resistance to relative movement as the larger sheave housings 102 weigh more. The number of locking bars 125 per type of sheave housing 102 is but exemplary; additional embodiments are envisioned. Furthermore, the cross bar 124 may include a channel by virtue of the surface distanced from the sheave housings 102 including a lip portion that is thicker than the rest of the cross bar 124. The locking bar 125 may be sized to fit within this channel formed by the cross bar 124 and within the gap between the cross bar 124 and the bracket surface.

FIG. 6 shows the locking bar 125 inserted in the gap formed between the cross bar 124—or locking surface—and the surfaces 119*a*, 119*b*, 119*c* of the bracket, wherein relative movement between the sheave housing 102 and the cross beam 118 is substantially prevented. This immobilization of the sheave housing 102 from moving with respect to the cross beam 118 is helpful during both assembly of the hook block 100 and during reeving, which will be discussed in more detail below. The locking bar 125 includes a handle to facilitate insertion and removal thereof from the gap. When the hook block 100 is lifted from the ground to be placed in lifting operation, the locking bars 125 are removed so that the cross beam 118 can pivot relative to the sheave housings 102.

Figure 19:
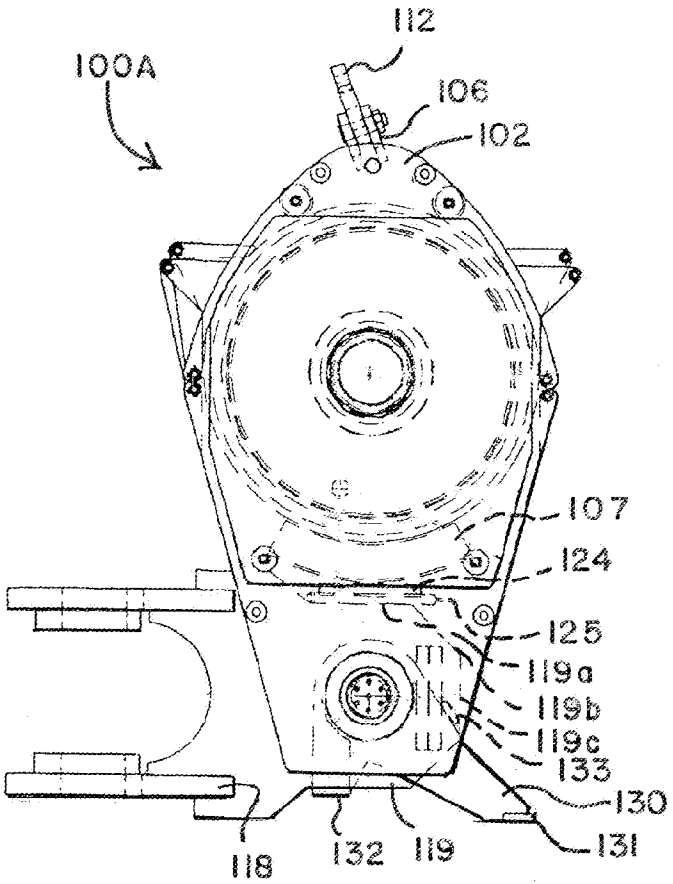
FIG. 19 is a side view of a hook block subassembly of the hook block of FIG. 2, wherein the hook block subassembly is laid down on the ground with the sheave housing(s) at a 90° angle with respect to the cross beam(s), and the stabilizing feet and the locking bars provide immobilization for reeving.
Figure 21:
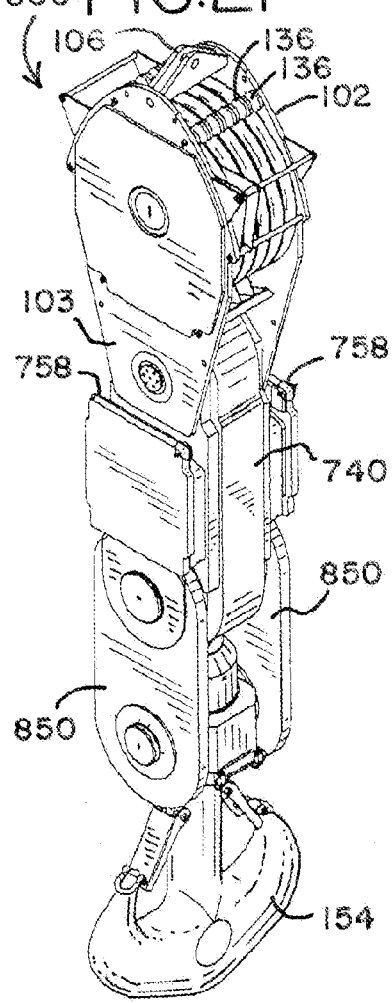
FIG. 21 is a perspective view of an alternative embodiment of the hook block of FIG. 17, using a connection plate in lieu of a triangular hook suspension plate.
Figure 22:
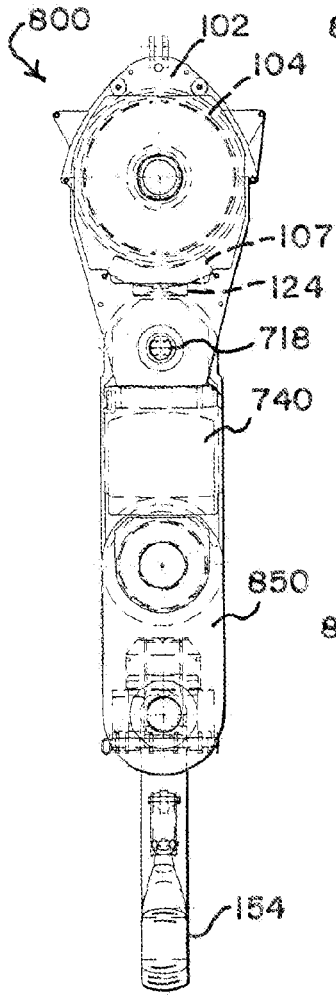
FIG. 22 is a side view of the hook block of FIG. 21.
Figure 23:
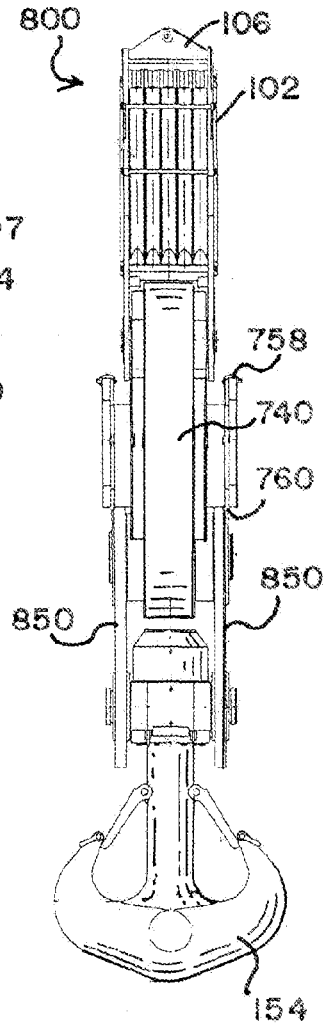
FIG. 23 is a front elevation view of the hook block of FIG. 21.

As seen in FIGS. 3-4 and 6, one or more stabilizing feet 130 may be rotatably attached to the shaft 121 between brackets 119 of the cross beams 118. The stabilizing feet 130 include a hole for the shaft, a flat portion 131 at one end, and a counterweight 132 at the other end that appears like the heel of a boot. The flat portion 131 and the counterweight 132 are extended away from the shaft 121 on opposing sides thereof to create a center of gravity that promotes the flat portions 131 to naturally swing toward the ground as the cross beams 118 pivot through 90° when being laid horizontally on the ground in preparation for reeving. When the locking bars 125 are installed in locking positions, the sheave housing 102 will be supported in upright positions from tipping by the stabilizing feet 130 on one side and by the weight of the block on the other side of the hook block 100 (FIG. 19). A stop 133 (FIG. 19) is attached between the two brackets 119 in which the stabilizing feet 130 are located to prevent rotation of the stabilizing feet beyond 90°, measured with respect to the cross beam 118, when vertical.

Figures 39, 40:
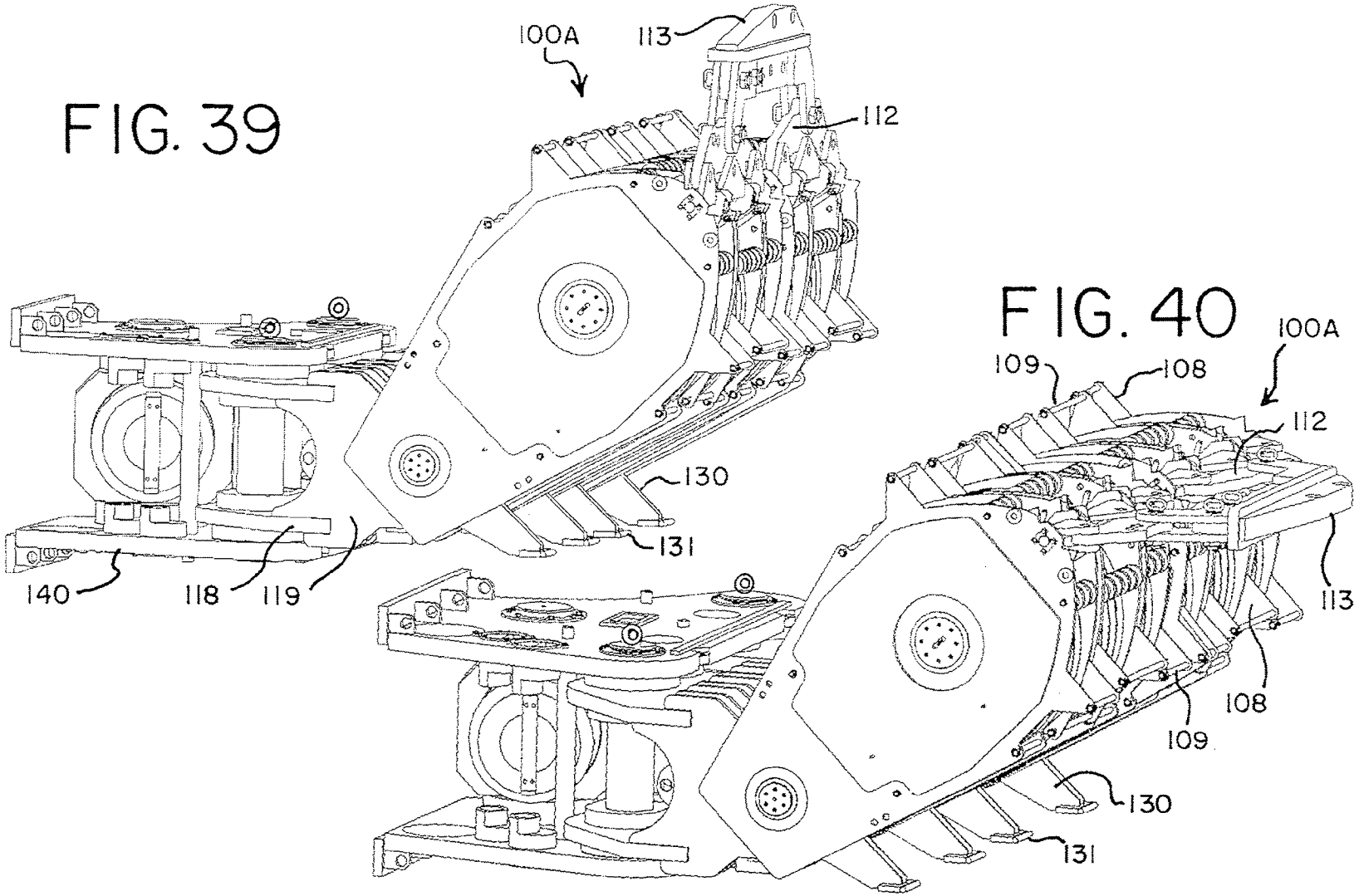

As shown in FIGS. 2-3 (and FIG. 26), the connection links 106 are rotatably attached to the sheave housing 102, and can rotate along an axis parallel with that of the shaft 121 so that they are moved to one side of the housing 102 during reeving. Any connection beams 112, 113 attached to the connection links 106 are thus also rotatable (FIG. 40). This allows the wire rope better access into the sheaves 104, but there is still a chance that the wire rope will be rubbed across the connection links 106 and be damaged.

Figure 8:
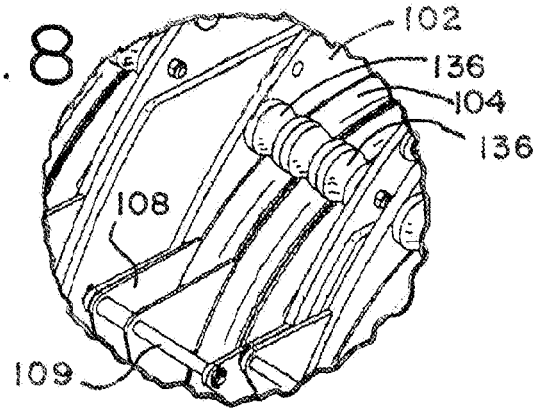
FIG. 8 is an enlarged perspective view of deflection rollers of the hook block of FIG. 2, the deflection rollers designed to deflect a wire rope during reeving.

FIG. 8 shows a number of deflection rollers 136 designed to deflect a wire rope during reeving. The deflection rollers 136 are rotatably attached between sides of the sheave housing 102 and adjacent the sheaves 104 located therein. Each deflection roller 136 includes a groove along a plane corresponding to the groove of each respective sheave 104 to which it is adjacent. The grooves of the sheaves 104 and the deflection rollers 136 may be substantially or exactly of the same diameter. The wire rope threaded through the hook block 100 during reeving may be run over the deflection rollers 136 and therefore away from the connection links 106. The deflection rollers 136 may be made of nylon or another acceptable material.

Figure 34:
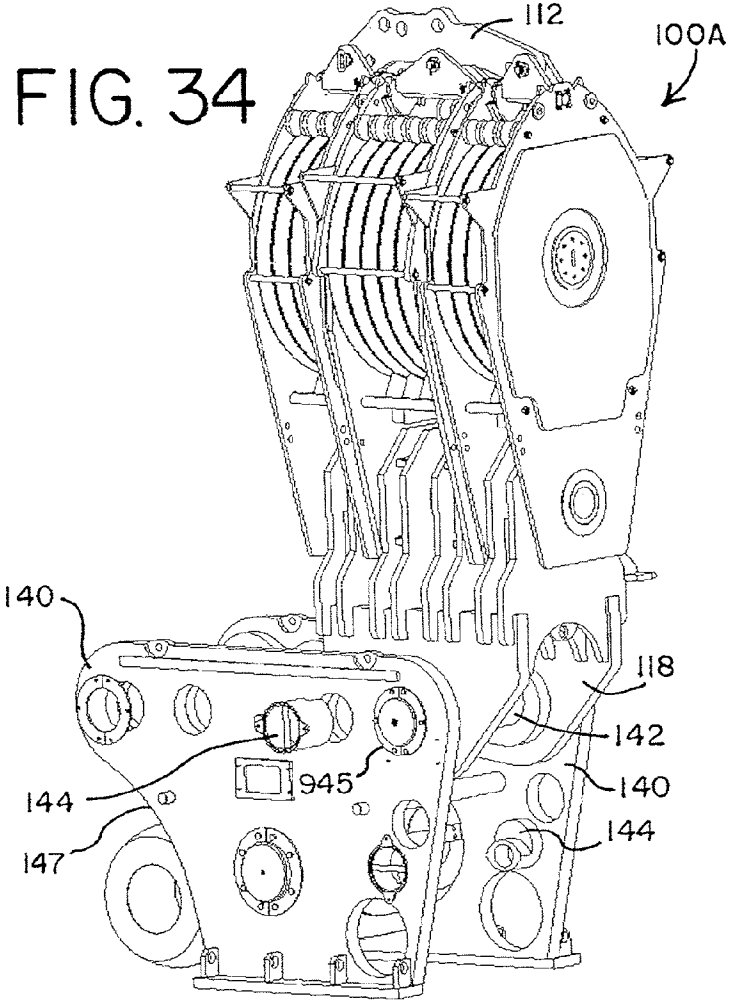
Figure 33:
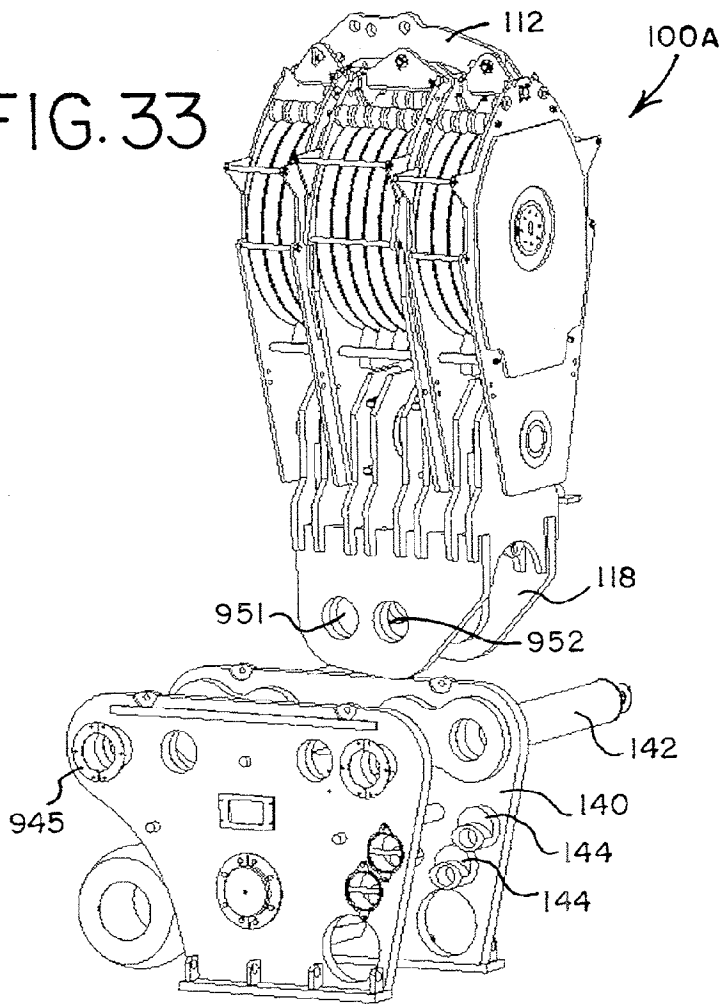

The right cross beam 118 is the cross beam 118 seen on the right side of the equalizer beam 140 in the view as seen in FIG. 3. The left cross beam 118, accordingly, is the one seen on the left side of the equalizer beam 140 in FIG. 3. Each cross beam 118 includes opposing plates and, at a bottom portion of the opposing plates, at least two apertures in each plate are aligned with the two apertures of the other plate (best seen in FIG. 33). The equalizer beam 140 also includes opposing plates that can be positioned to the outside of the opposing plates of each cross beam 118. Along a top portion of each opposing plate of the equalizer beam 140 are four apertures 141 aligned with the apertures 141 of the other plate. These four sets of aligned apertures 141 substantially align with the aligned apertures of the opposing plates of each cross beam 118. In hook block 100, the outside two sets of aligned apertures 141 of the equalizer beam 140 are lined up with the outside set of aligned apertures from the opposing plates of each cross beam 118, through which a long pin 142 is inserted to secure the cross beams 118 to the equalizer beam 140 (FIGS. 33 and 34). The opposing plates of the equalizer beam 140 and the cross beams 118 are laterally pivotal about the long pins 142.

Because the embodiments discussed below include fewer numbers of sheave housings 102, and therefore total number of sheaves 104, the torque about a center line through the equalizer beam 140 based on the wire rope passing through each sheave changes the overall balance. Advantageously, therefore, all the aligned sets of apertures of the equalizer beam 140 do not exactly line up with the corresponding sets of aligned apertures of the cross beams 118 at the same time. The inner sets of the aligned apertures of the equalizer beam 140 and cross beams 118 may be used, therefore, when assembling a hook block 100 with fewer total sheaves for lifting a lighter load, as will be seen below.

When the equalizer beam 140 is attached to the cross beams 118 in hook block 100, the remaining (inner) sets of aligned apertures from the equalizer and cross beams 140, 118 form four crescent-shaped apertures 143, one along the bottom of each opposing plate of both cross beams 118. Four pins 144 specially sized for insertion into the crescent-shaped apertures 143 are stored in additional holes formed in the center and to one side of the plates of the equalizer beams 140. These pins 144 have crescent-sized end portions that fit into the crescent-shaped apertures 143, and may also be referred to herein as crescent-shaped pins or securing pins. During the assembly of the hook block 100, the pins 144 are removed from their storage positions and inserted into the crescent-shaped apertures to immobilize the equalizer and cross beams 140, 118 from relative movement.

The equalizer beam 140 includes a main eye 148 rotatably attached between its opposing plates, and includes an eye, or hole, at the other end thereof. The equalizer beam 140 also defines a cutout section 147 on one side thereof to allow the main eye 148 to rotate up and be strapped adjacent the cutout section 147 while the equalizer beam 140 stands on the ground during assembly. The equalizer beam 140 includes a longitudinal rail 149 on which to stand for placement on the ground during assembly of the hook block 100. The main eye 148 at its distal end is rotatably connected to the opposing hook suspension sideplates 150. The hook suspension sideplates 150 are in turn pivotally connected to the hook suspensions 152, 154, one without locking and another with locking, respectively. The hook suspensions 152, 154 include hook portions at the bottom thereof for attachment to the load to be lifted by the crane 10. The hook suspension 154 with locking includes a fork-like pin 155, which is inserted into a trunion between the hook suspension sideplates 150, to lock the hook suspension 154 from rotating.

As discussed above, the hook blocks 200-600 shown in FIGS. 9-16 use different combinations of the same components used for hook block 100. Accordingly, the changes from hook block 100 will be discussed, without repetition of the same features already disclosed above. A fewer number of sheave housings 102, and therefore cross beams 118 in some embodiments, may be required to lift lighter loads. Having a lighter hook block 100 means that assembly of the hook block 100 is simplified and can be done quicker on the job site. Furthermore, the total load being lifted by the crane 10 can be reduced, allowing for more efficient operation and need for fewer counterweights.

Figure 9:
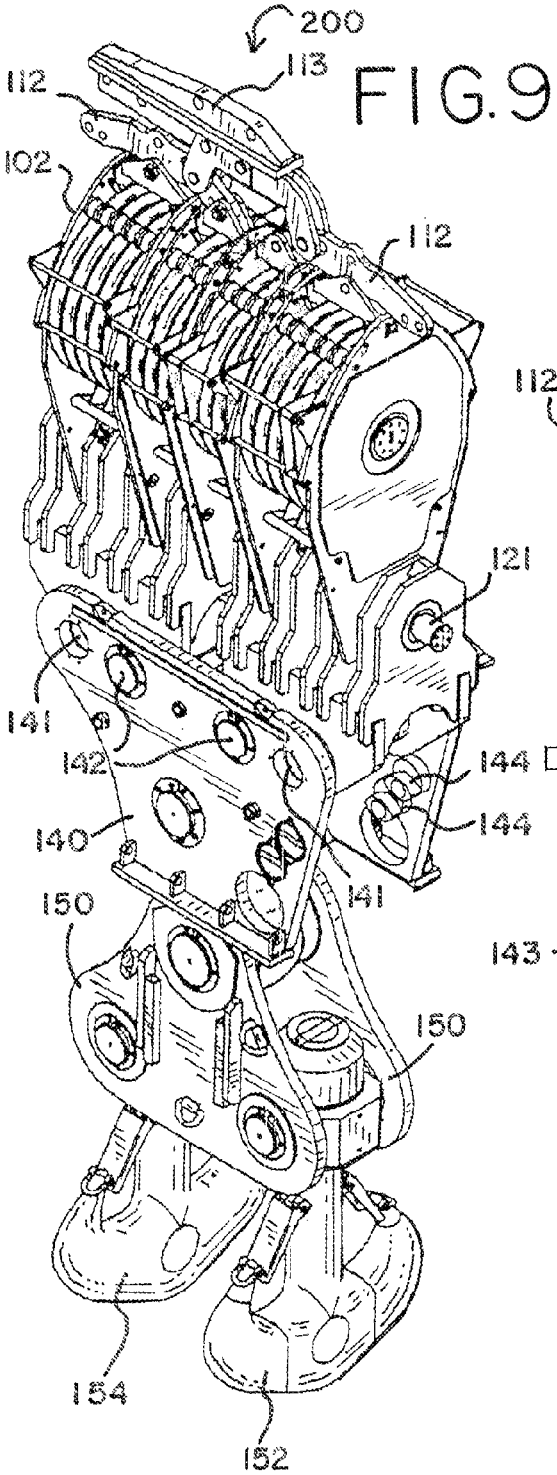
FIG. 9 is a perspective view of an alternative embodiment of the hook block of FIG. 2, using a fewer number of 3-sheave housings.
Figure 10:
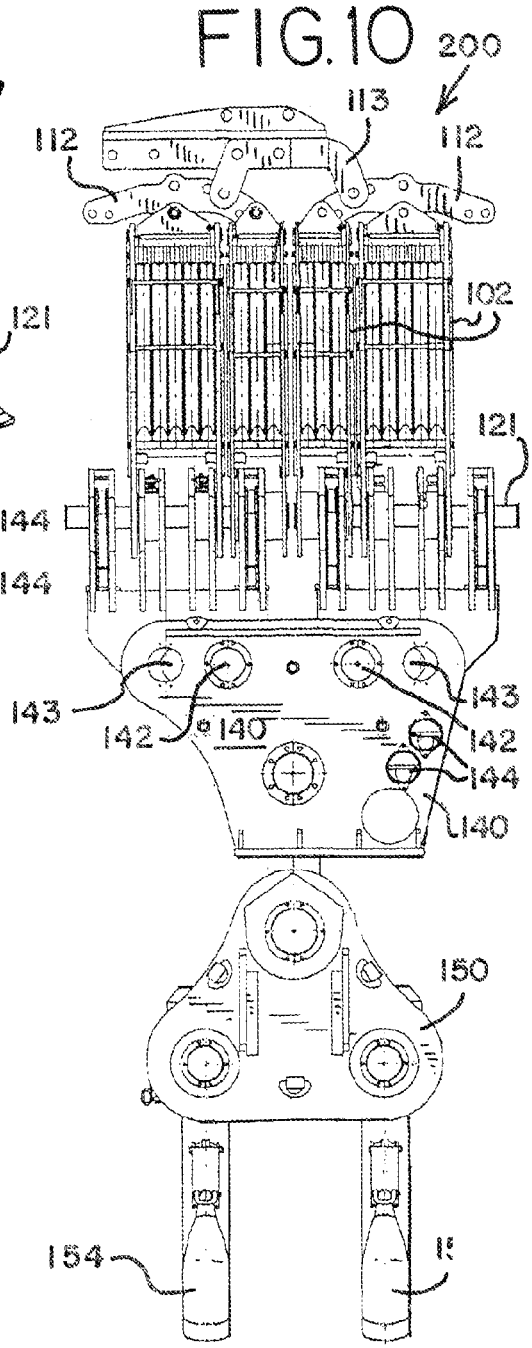
FIG. 10 is a front elevation view of the hook block of FIG. 9.

FIGS. 9-10 show hook block 200, which is similar to hook block 100 except for using a fewer number of 3-sheave and 5-sheave housings 102. The hook block 200 includes a three-sheave and a five-sheave housing 102 on each side of the hook block, which allow lifting up to 1,400 metric tonne.

For this hook block 200, the inner two of the four sets of aligned apertures 141 of the equalizer beam 140 may be used for insertion of the long pin 142 that pivotally connect the equalizer beam 140 to each cross beam 118. This allows the connection points between the equalizer and cross beams 140, 118 to be brought closer together as the weight from the sheave housings 102 is also brought in more centrally in the hook block 100, as will also be applicable to the below embodiments. The result of aligning the inner sets of the aligned apertures 141 of the equalizer beam 140 with the inner aligned apertures of the cross beams 118 is that the outer sets of aligned apertures of each now form the crescent-shaped apertures 143, instead of the outer sets thereof as before. The crescent-shaped pins 144 specially sized for insertion in the crescent-shaped apertures 143 may be inserted therein to immobilize the equalizer 140 and cross beams 118 from relative movement during assembly.

The shaft 121 is now somewhat exposed at either end of the sets of sheave housings 102. So, also, are the connection beams 112. Note, however, that these components are designed to be adapted for use with a smaller hook block employing fewer sheave housings 102. The main connection beam 113 is still usable to connect the two connection beams 112.

FIGS. 11-12 show hook block 300, which uses four 3-sheave housings 102 that allow lifting up to 1,200 metric tonne. This hook block 300 is substantially similar to hook block 200 except for using four fewer sheaves 104 overall, making the overall width of the sheave housing assemblies somewhat narrower. As a result, the shaft 121 and the connection beams 112 are even more exposed at the ends thereof, although the hook block 300 may still be assembled from the same components as used in the embodiment of FIGS. 1-4.

As with the hook block 200 of FIG. 10, the equalizer beam 140 is pivotally connected to the cross beams 118 of hook block 300 through their respective inner sets of aligned apertures. The crescent-shaped pins 144 are sized to fit into the crescent-shaped apertures 143 of the outer sets of partially-aligned apertures, to immobilize relative movement between the equalizer 140 and the cross beams 118 during assembly of the hook block 300.

FIGS. 13-14 shows hook block 400, which uses two 5-sheave housings 102 that allow for lifting up to 1,000 metric tonne. Now only two sheave housings 102, each having five sheaves 104, are used to assemble the hook block 400. Accordingly, only a single connection beam 112 is needed to connect the two sheave housings 102 together, by which the hook block 400 is also lifted during assembly and reeving.

In hook block 400, only the hook suspension 152 without locking is used, although the hook suspension with locking 154 could also be employed in addition to, or in lieu of, the hook suspension 152 with locking. Where the single hook suspension 152, 154 is used, the pivotal connection points between the hook suspension sideplates 150 and both the main eye 148 and the hook suspension 152, 154 all line up vertically under the equalizer beam 140, as shown.

As with hook block 200, the equalizer beam 140 is pivotally connected to the cross beams 118 of hook block 400 through their inner sets of aligned apertures of opposing plates. The crescent-shaped pins 144 are sized to fit into the crescent-shaped apertures 143 of the outer sets of partially-aligned apertures, to immobilize relative movement between the equalizer beam 140 and the cross beams 118 during assembly of the hook block 300.

Figure 15:
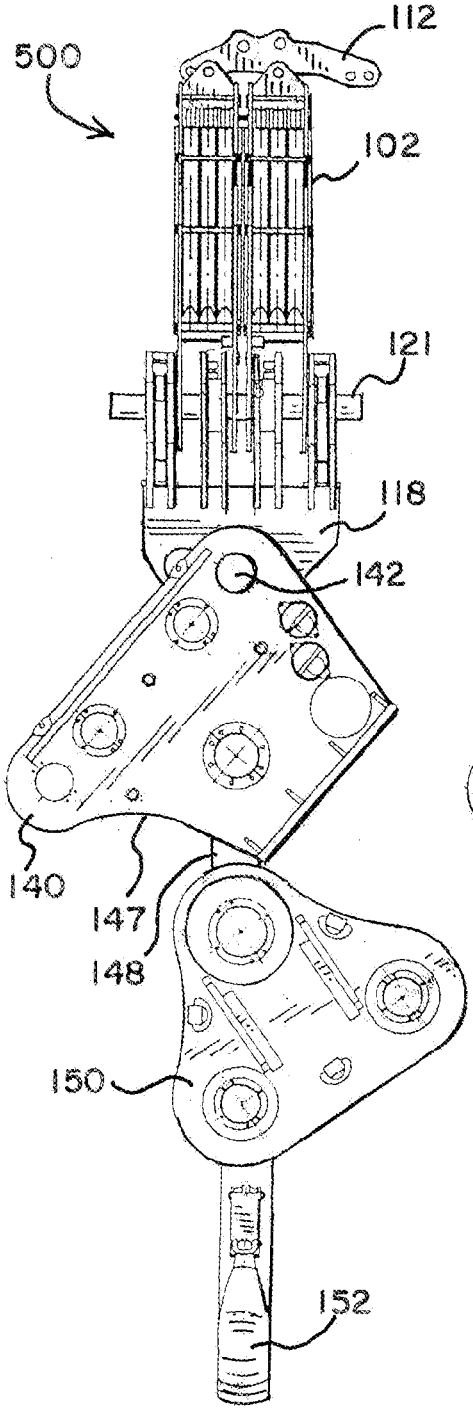
FIG. 15 is a front elevation view of an alternative embodiment of the hook block of FIG. 2, using two three-sheave housings and a single cross beam.

FIG. 15 shows hook block 500, which uses two three-sheave housings and a single cross beam, which allow lifting up to 600 metric tonne. The hook block 500 further includes from Table 1: a connection beam 112, the right cross beam 118, the equalizer beam 140; two hook suspension sideplates 150; and the hook suspension 152 without locking, although the hook suspension 154 with locking could also be used. The connection beam 112 connects the sheave housings 102 to each other at the connection links 106 thereof.

Of the four sets of aligned apertures 141 of the equalizer beam 140, the one farthest from the cutout section 147 is aligned with the outer set of aligned apertures of the right cross beam 118, through which one of the long pins 142 is used to secure the equalizer beam 140 to the cross beam 118. The two three-sheave housings 102 are aligned over the long pin 142 connection point and generally centered within the cross beam 118. This single point of connection causes the equalizer beam 140 to pivot with gravity, causing its orientation to change by about 45 degrees. As with hook block 400 shown in FIG. 14, the hook suspension 150 also pivots about the main eye 148 as the hook suspension 152, 154 pulls down with gravity. While some of these components look skewed when compared with hook blocks 100-300, they are still effective and may be used to assemble the hook block 500 without need to manufacture additional components.

Figure 16:
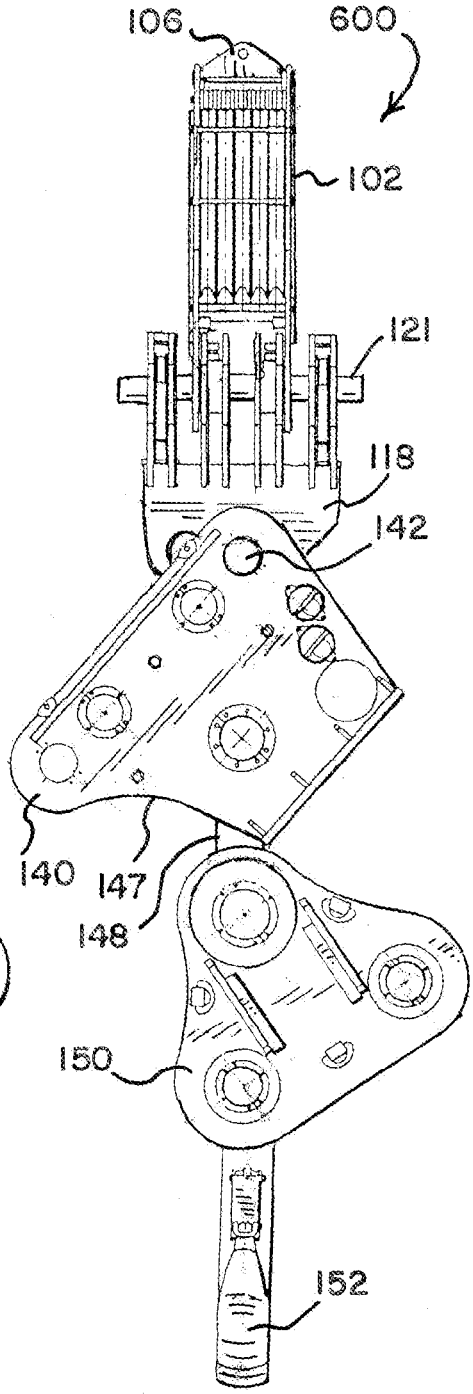
FIG. 16 is a front elevation view of an alternative embodiment of the hook block of FIG. 15, using one five-sheave housing.

FIG. 16 shows hook block 600, which uses one five-sheave housing 102 that allows lifting up to 500 metric tonne. This embodiment is substantially the same as that of FIG. 15 except for using the one five-sheave housing 102 in lieu of two three-sheave housings 102. The five-sheave housing 102 is substantially centered over the connection point between the right cross beam 118 and the equalizer beam 140.

Figure 17:
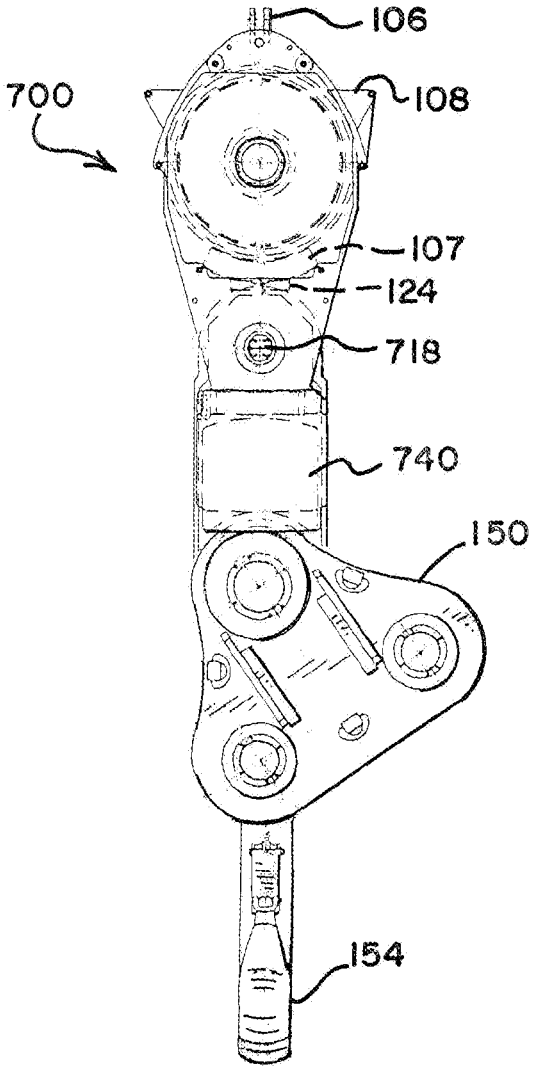
FIG. 17 is a side view of an alternative embodiment of the hook block of FIG. 16, using a link plate and a shaft link plate.
Figure 18:
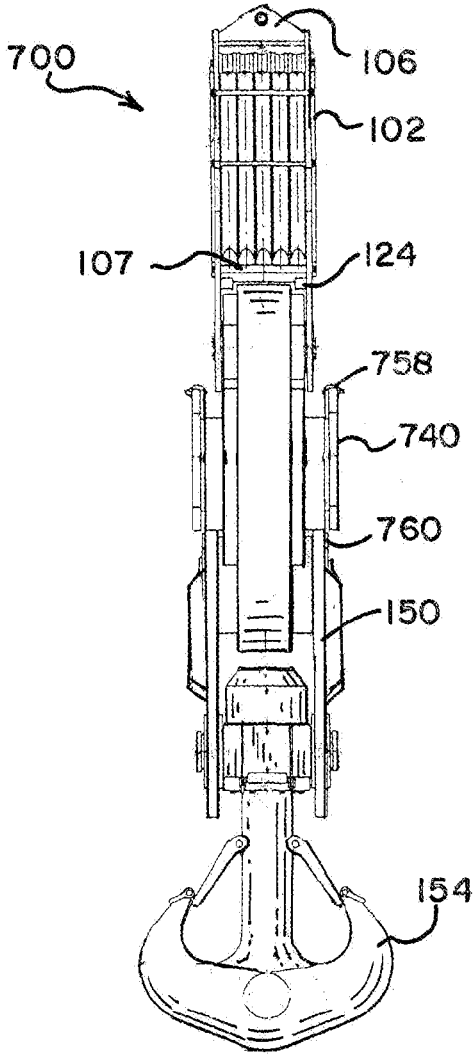
FIG. 18 is a front elevation view of the hook block of FIG. 17.

FIGS. 17-18 shows hook block 700, which includes a five-sheave housing 102, two hook suspension sideplates 150, the hook suspension 154 with locking, a link plate shaft 718, and a link plate 740. Hook block 700 is thus configured to lift up to 500 metric tonne using the previous-mentioned specialty pieces: the link plate shaft 718 and the link plate 740. The hook suspension 152 without locking may be substituted as well, as discussed above.

Figure 25:
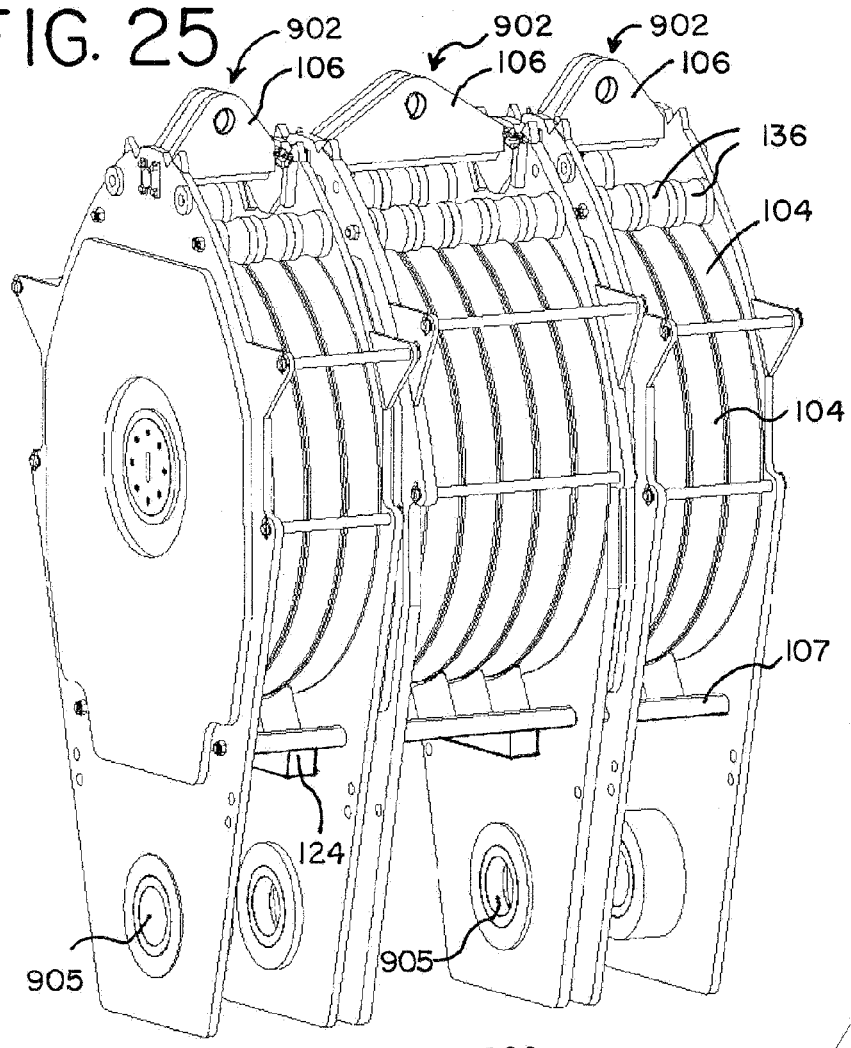

The extended portions 103 of the five-sheave housing 102 include female ears about the holes therethrough (best seen in FIG. 25). The link plate 740 is a thick plate with bosses at the top, or at a first end, and which form a male ear (not shown) about holes at the first end. The link plate shaft 718 is rotatably captured within the holes of the extended portions 103 of the five-sheave housing 102 and of the first end of the link plate 740. The male ear of the holes of the link plate 740 fits into the female ears of the extended portions 103.

The link plate 740 is rectangular and has a smaller profile to more closely match the width of the five-sheave housing 102. A hole at the second end of the link plate 740 is pivotally connected to the hook suspension sideplates 150, which in turn is pivotally connected to the hook suspension 154 with locking. The connection points between the components of the hook block 700 align vertically as they naturally hang below each other under the force of gravity.

The sheave housing 102 includes the locking surface (or cross beam) 124 along the bottom of the frame housing 107. Between the locking surface and an upper portion of the link plate 740 is formed a gap into which the locking bar 125 (not shown) is inserted to immobilize relative movement between the sheave housing 102 and the link plate 740 during reeving and/or assembly.

The link plate 740 includes a link plate locking bar storage 758 on an outer portion thereof to store therein a link plate locking bar (not shown). A space 760 is formed between this outer portion and the body of the link plate 740 at a bottom part thereof for insertion of the link plate locking bar (not shown) in order to immobilize relative movement between the link plate 740 and the hook suspension plates 150 during reeving.

Figure 20:
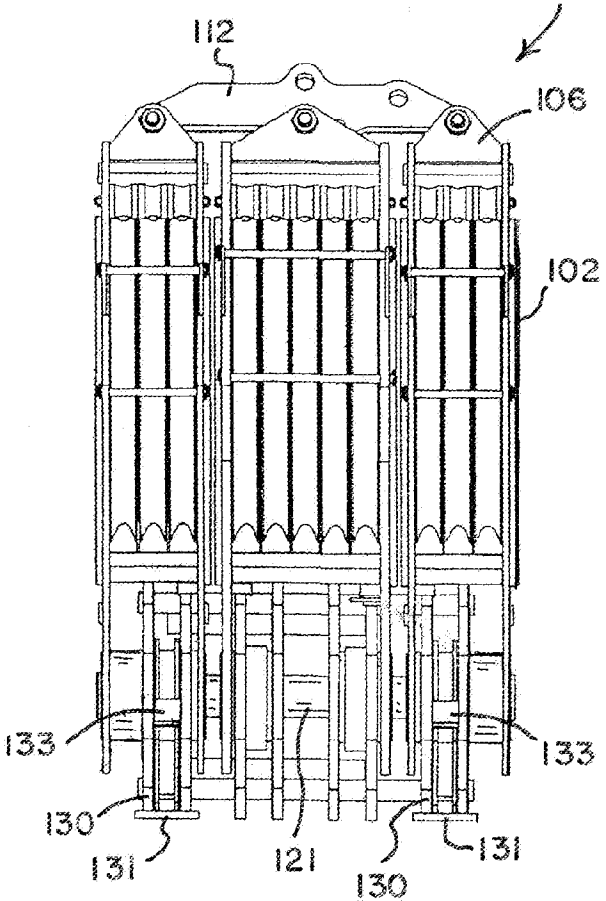
FIG. 20 is a front elevation view of the hook block subassembly of FIG. 19.

FIGS. 19-20 show a hook block subassembly 100A of the hook block 100 of FIG. 2, wherein the hook block subassembly 100A is laid down horizontally on the ground with the sheave housing(s) 102 at a 90° angle with respect to the cross beam(s) 118, and stabilizing feet 130 and locking bars 125 provide immobilization for reeving. Aspects of the hook block 100 already disclosed will not be repeated here. The below explanation with reference to FIGS. 19 and 20 is also applicable to hook blocks 200-800, except for the stabilizing feet 130 that are not included where a cross beam 118 is not used.

Surface 119*a* of one of the brackets 119 of the cross beam 118 forms a gap between it and the locking surface (or cross bar) 124 of the housing frame 107. The locking bar 125 is inserted into this gap to immobilize the sheave housings 102 at the 90° angle with respect to the cross beam 118. The sheave housings 102 may also be further lowered to a 45° angle or a 0° angle, and be similarly immobilized with the locking bar 125 against surfaces 119*b* and 119*c*, respectively.

A second aspect of the immobilization includes the stabilizing feet 130 discussed above, each of which are rotatably attached between two brackets 119. Because they freely rotate with gravity due to the counterweight 132 end, the stabilizing feet 130 swing the flat portion 131 thereof toward the ground as the cross beam 118 is laid down. This allows the weight of the sheave housings 102 to be stabilized between the weight of the lower portion of the hook block—everything including the cross beam 118 and below—and the stabilizing feet 130. The stop 133 is attached across the two brackets 119 between which each stabilizing foot 130 rotates. The stop 133 prevents rotation of the stabilizing feet 130 beyond 90° degrees, measured with respect to the cross beam 118, when vertical.

The 90° orientation, as displayed in FIG. 19, with the lower part of the hook block 100 on the ground, is preferable when the wire rope 24 to be reeved hangs down from the boom 22 generally directly above the hook block 100. The connection beam 112 is pivotal to either side to help prevent contact with the wire rope 24 during reeving. The deflection rollers 136 near the top of the sheave housings 102 will also help deflect the wire rope away from the connection links 106. The 45° orientation with respect to the ground is preferable if the top of the boom 22 is horizontally distanced from the location of the hook block 100, and the wire rope is coming in at an angle. Further aspects of assembly and reeving will be discussed in more detail below.

FIGS. 21-24 show hook block 800 of the hook block 700, which includes a five-sheave housing 102, a hook suspension 154 with locking, a link plate shaft 718, a link plate 740, and two connection plates 850. Hook block 800 is thus configured to lift up to 500 metric tonne, and is an alternative embodiment of hook block 700, including the connection plates 850 in lieu of the hook suspension sideplates 150. The hook suspension 152 without locking may be substituted as well, as discussed above.

The connection plates 850 provide for hook suspension similar to that of the hook suspension plates 150. The connection plates 850 are elongated and fit the narrower profile of the hook block 800 with a single five-sheave housing 102. Each connection plate 850 includes holes at either end that align with those of the other connection plate. The top set of aligned holes provide pivotal connection to the hole at the second end of the link plate 740 and the bottom set of aligned holes provide pivotal connection to the hook suspension 152, 154.

Figure 24:
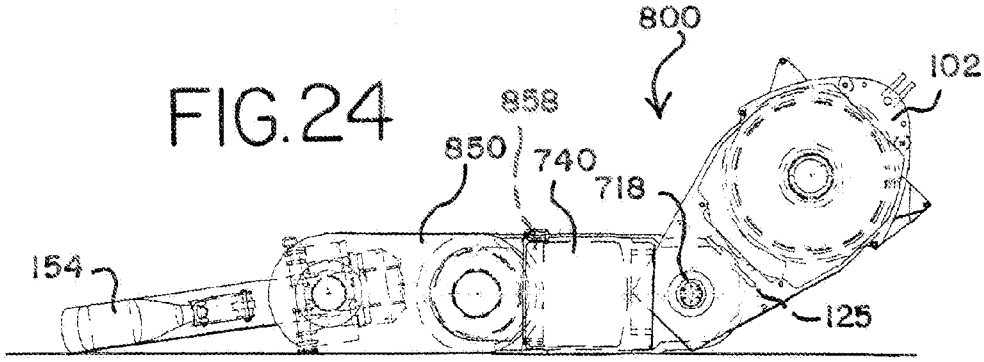
FIG. 24 is a side view of the hook block of FIG. 21, shown lying down with its sheave housing at a 45° angle.

The link plate 740 includes a link plate locking bar storage 758 on an outer portion thereof to store therein a link plate locking bar 858, which is best seen in FIG. 24. A space 760 is formed between this outer portion and the body of the link plate 740 at a bottom part thereof for insertion of the link plate locking bar 858 in order to immobilize relative movement between the link plate 740 and the hook suspension plates 150 during reeving. FIG. 24 shows the hook block 800 lying down horizontally with its sheave housing 102 at a 45° angle. The locking bar 125 is inserted between the locking surface 124 of the frame housing 107 and the angled surface of the shaft link plate 718. With placement of the link plate locking bar 858 in the space 760, buckling between the connection plates 850 and the link plate 740 is prevented and the sheave housing 102 is supported by the weight of the lower portion of the hook block 800.

FIG. 25 through FIG. 46 show the hook block 100 of FIGS. 2-4, displaying step-by-step assembly thereof, wherein FIG. 25 displays a set of sheave housing assemblies 902. Each sheave housing assembly 902 is assembled with a sheaving housing 102 containing multiple sheaves 104, a connection link 106 pivotally attached to the top thereof, a frame housing 107 attached at the bottom thereof, and at least one cross bar 124 attached to the bottom of the frame housing 107. Each sheave housing assembly 902 also includes a plurality of deflection rollers 136 rotatably attached near the top of the sheave housing 102, adjacent the sheaves 104. The sheave housings 102 include extended portions 103, each with a hole 905 therethrough.

Figure 26:
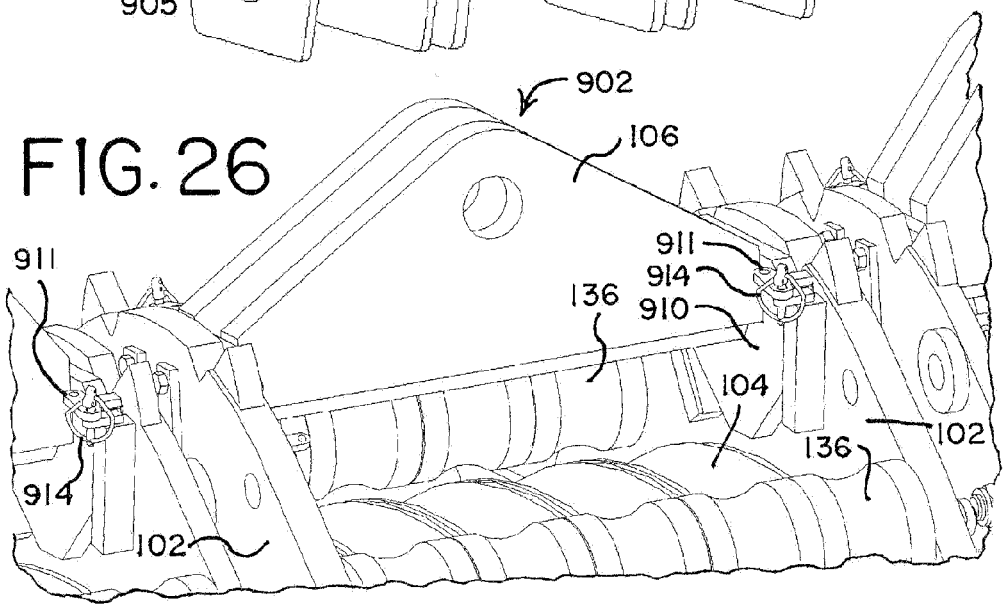

FIG. 26 shows the connection link 106 connected to each of the sheave housings 102 of FIG. 25. The connection link 106 includes side plates 910, a plurality of locking strips 911, and a safety linch-pin 914 to lock each locking strip 911 into place. Removal of the safety linch-pin 914 and locking strip 911 allows the connection link 106 to pivot forward or backward between sides of the sheave housing 102.

Figure 27:
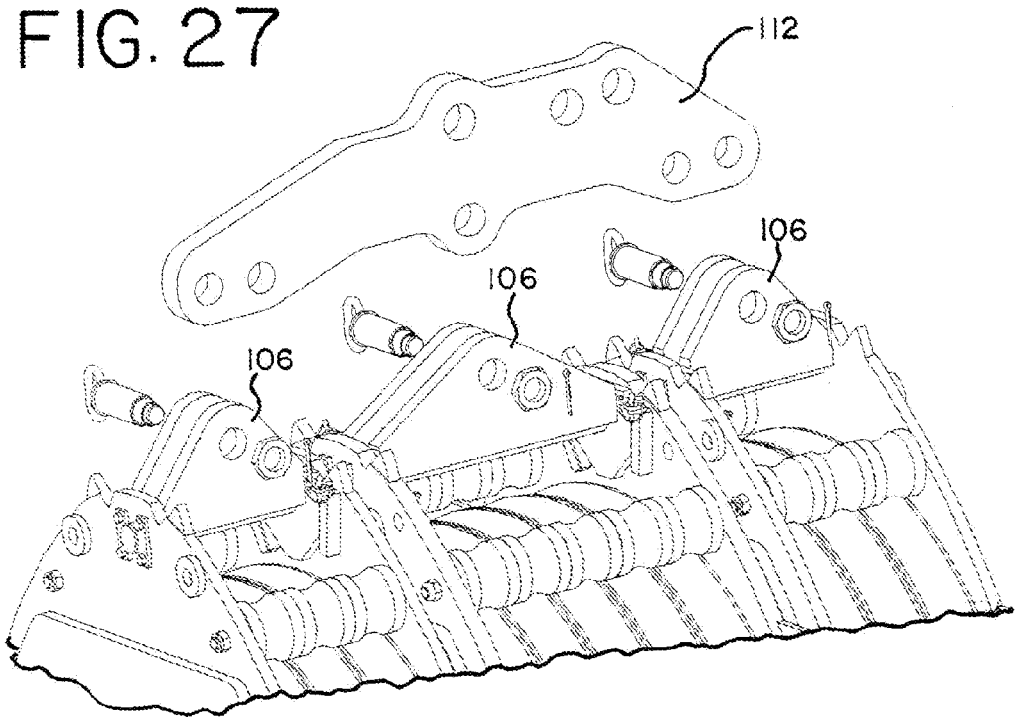

FIG. 27 shows connecting a connection beam 112 to the connection links 106 of FIG. 25. The holes of the connection beam 112 line up with the connection links 106 for different combinations of three-sheave and five-sheave housings 102. Bolts and nuts connect the connection beam 112 to the connection links 106.

Figure 28:
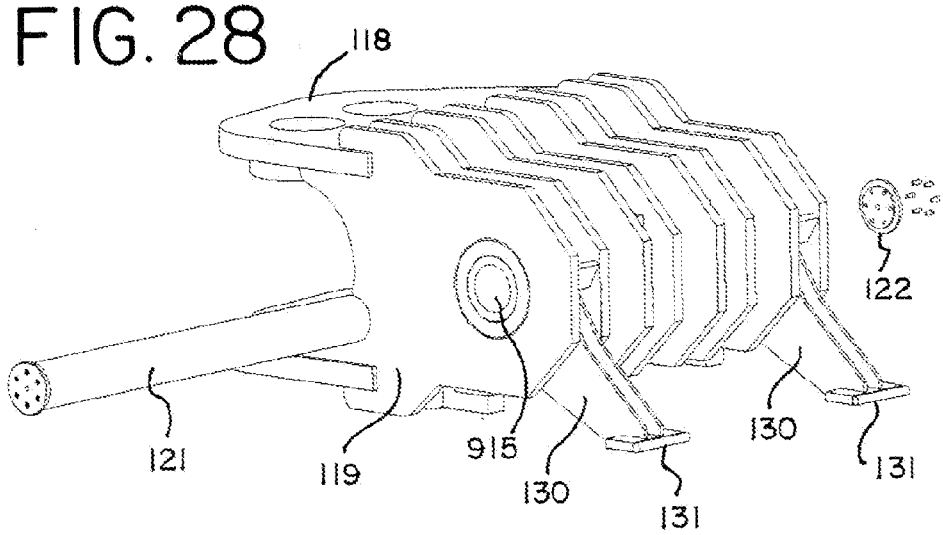

FIG. 28 shows a cross beam 118 and shaft 121 for assembling the hook block 100 of FIG. 2, the cross beam 118 including stabilizing feet 130. Note how the stabilizing feet swing out from between two brackets 119 of the cross beam 118 and the flat portions 131 thereof come into contact with the ground. The cap 122 for the shaft 121 is attachable to the shaft 121 with a number of bolts to secure the shaft 121 after it is rotatably captured inside holes of the extended portions 103 of the housings 102 and within holes of the brackets 119. Each bracket 119 includes a hole 915, one of which is visible in FIG. 28.

FIG. 29 shows the shaft 121 being rotatably captured within the cross beam 118 and the sheave housing assemblies 902 of FIG. 25. The collection of sheave housing assemblies 902, as connected together with the connection beam 112, is lifted by an assist crane at the connection beam 112 and lowered onto the cross beam 118 that is lying on the ground with its brackets 119 at a 90° angle with respect to the sheave housings 102. The holes 905 in the extended portions 103 of the sheave housings 102 are aligned with holes 915 in the distal ends of the brackets 119. The shaft 121 is rotatably captured within the aligned holes 905, 915 and the cap 122 is secured on the end thereof with bolts, as seen in FIG. 29A, to prevent dislodging the shaft 121 after assembly.

FIG. 30 shows insertion of the locking bars 125 between the cross bars 124 of the housing frame 107 and the brackets 119 of the cross beam 118. This will immobilize the sheave housing assemblies 902 with respect to the cross beam 118 so that the assist crane line may be disconnected from holding the hook block subassembly 100A.

FIG. 31 shows the equalizer beam 140 after being placed on the ground, standing on its longitudinal rails 149. The long pins 142 are aligned with sets of aligned apertures 141, ready for connection to the cross beams 118. The crescent-shaped pins 144 are stored in their respective storage holes. A locking ring 945 and set of bolts are used to secure the long pin 142 to the equalizer beam 140 after insertion through the equalizer and cross beams 140, 118.

FIG. 32 shows the hook block subassembly 100A being lifted into the air and the locking bars 125 removed. Lifting the hook block subassembly 100A into the air by the assist crane allows pressure to be release from compressing the locking bars 125, allowing for them to be removed.

FIG. 33 shows the partially-assembled hook block of FIG. 32 being lowered by the assist crane between plates of the equalizer beam 140 of FIG. 31. The equalizer beam 140 is standing on the ground, so the hook block subassembly 100A can be lowered until the opposing plates of the cross beam 118 sit in between one half of the opposing plates of the equalizer beam 140. The cross beam includes a set of aligned inner apertures 951 and a set of outer aligned apertures 952. In this embodiment, the outer set 952 of the aligned apertures of the cross beam 118 align with an outer set of aligned apertures 141 of the equalizer beam 140, through which the long pin 142 is inserted to pivotally attach the cross beam 118 to the equalizer beam 140.

FIG. 34 shows pivotally connecting the cross beam 118 to the equalizer beam 140. A locking ring 945 is placed over the long pin 142, and bolts are used to attach the locking ring 945 to the equalizer beam 140. A crescent-shaped securing pin 144 is inserted between the cross beam 118 and the equalizer beam 140 at each opposing plate thereof to immobilize them from relative movement. A pair of bolts is used to secure the securing pins 144 to the equalizer beam 140.

Figure 35:
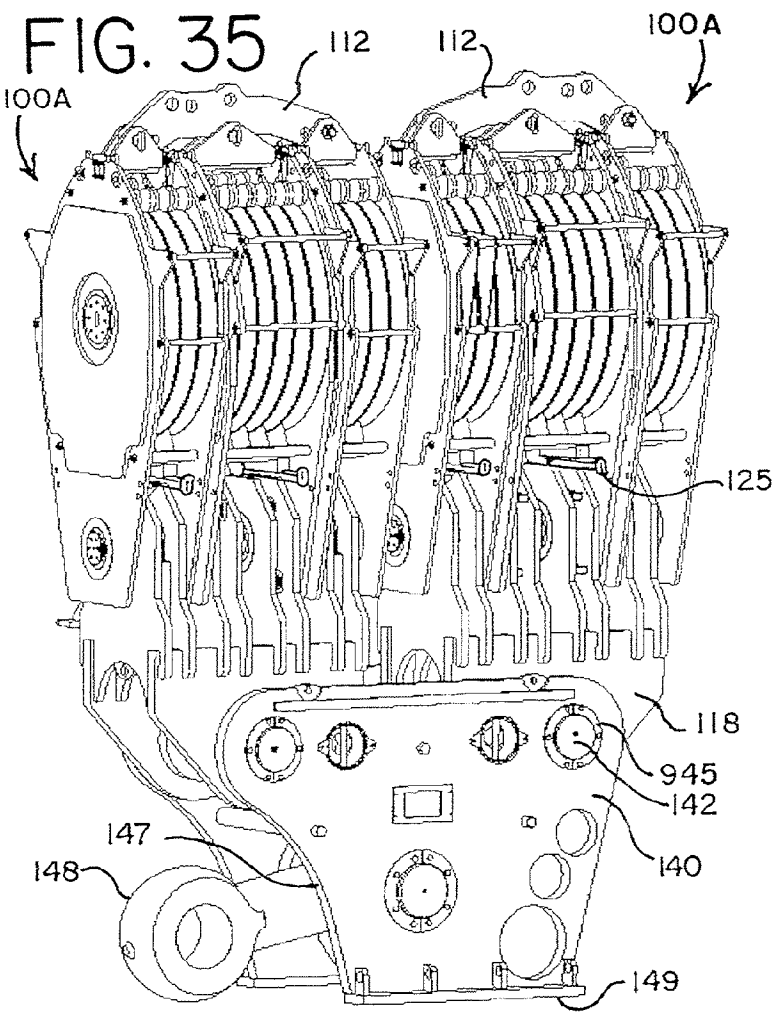

While not shown, the locking bars 125 are now inserted again to immobilize relative movement between the sheave housings 102 and the cross beam 118. FIG. 35 shows the partially-assembled hook block of FIG. 34 after repetition of the steps of FIGS. 25 through 34 to connect another set of sheave housing assemblies 902 to the other side of the equalizer beam 140. Note that the locking bars 125 are indeed in place in their locking positions between the cross bars 124 and the bracket surfaces 119*c*. The steps followed above to assemble the hook block subassembly 100A and attach it to the equalizer beam 140 are repeated in order to build and attach a second hook block subassembly 100A to the other side of the equalizer beam 140. Another set of crescent-shaped securing pins 142 are inserted and locked into place as described above.

Figure 36:
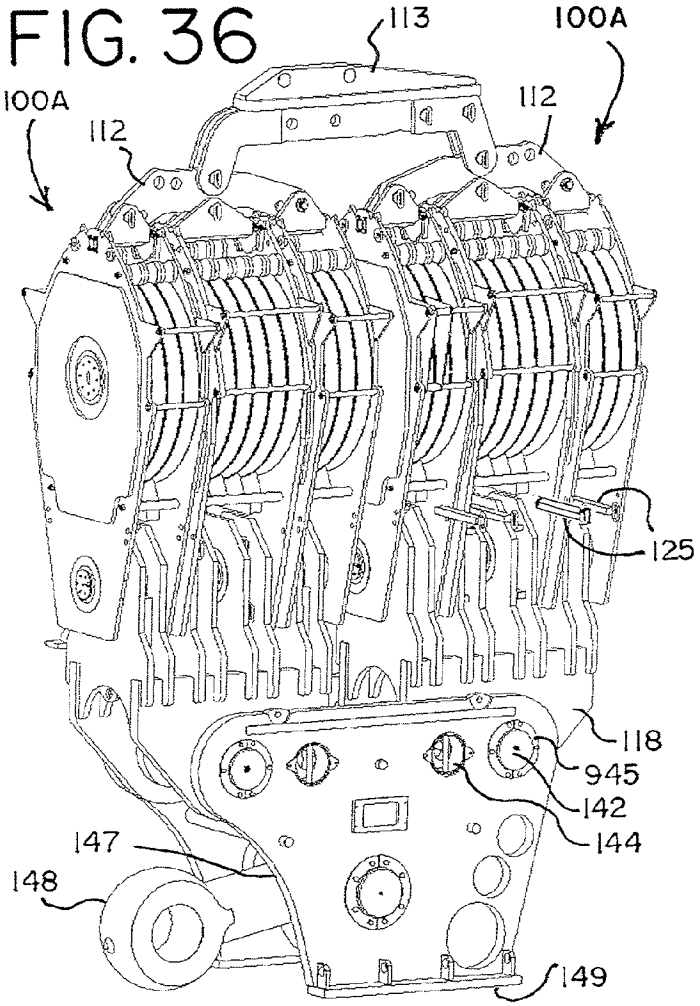

FIG. 36 shows attaching the main connection beam 113 to the connection beams 112 of each hook bock subassembly 100A of the partially-assembled hook block of FIG. 35. A strap (not shown) may be connected between the equalizer beam 140 and the main eye 148 to keep the main eye 148 up within the cutout 147 when the partially-assembled hook block is lifted. FIG. 36 also shows removal of the locking bars 125 as the assist crane begins to lift the partially-assembled hook block off the ground. The partially-assembled hook block is now ready to be laid onto the ground in preparation for reeving.

Figure 37:
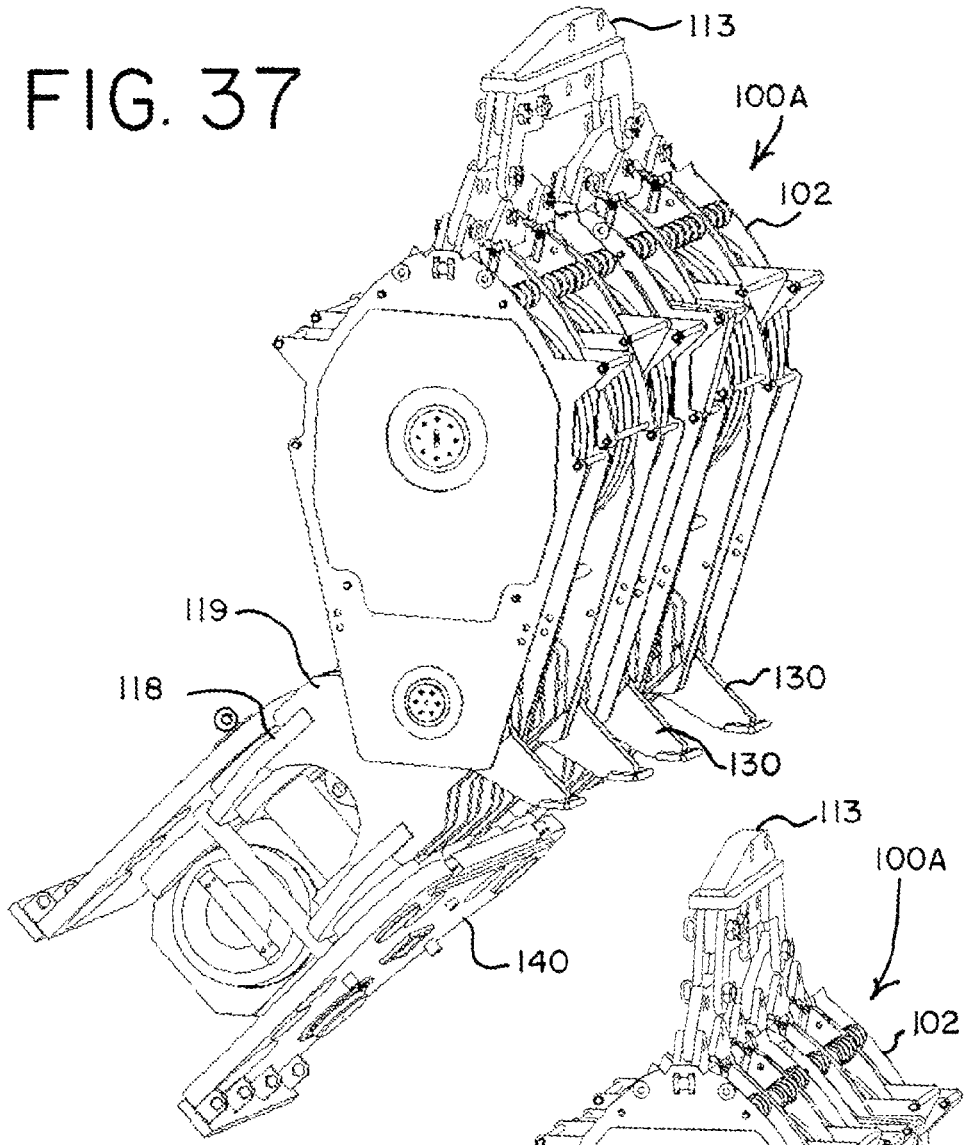
Figure 38:
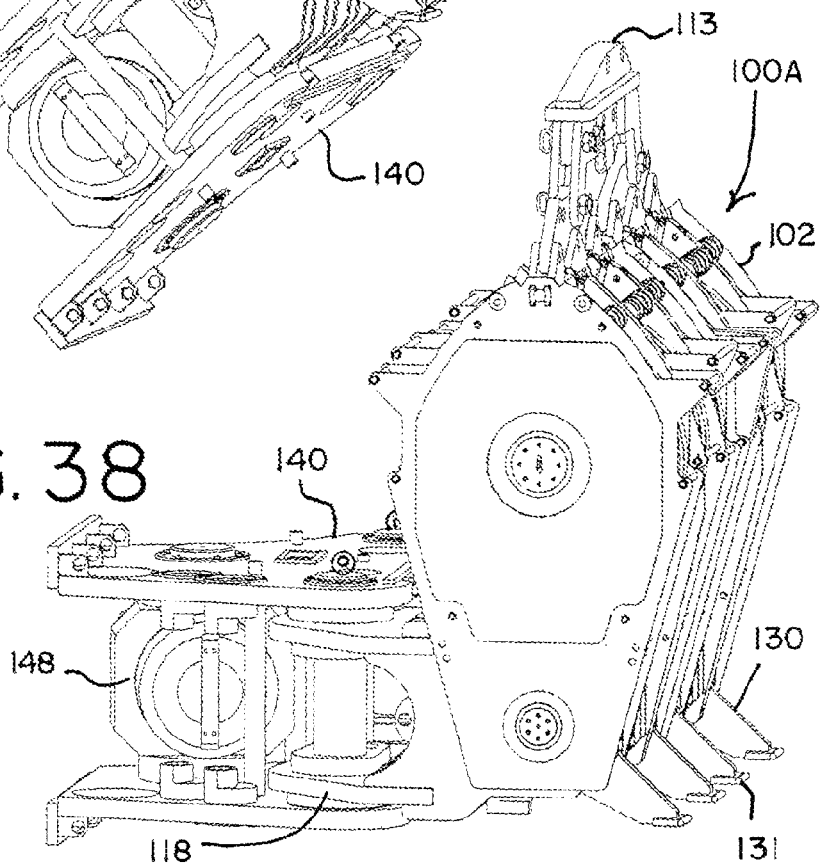

FIG. 37 shows the partially-assembled hook block being tilted over to a laying position. This should be done slowly with the help of the assist crane, so that the equalizer 140 goes into a laying position. The stabilizing feet 130 will automatically swing with the assembly, until they reach the ground for a stable position. FIG. 38 shows the partially-assembled hook block of FIG. 37 with the equalizer beam 140 and cross beam 118 laying on the ground, the sheave housing assemblies 902 being at a 90° angle to the cross beam 118 and stabilized with the stabilizing feet 130. In this position, the sheave housings 102 can be further lowered toward the ground to come to a 45° angle with respect to the ground, as shown in FIG. 39. To lock the partially-assembled hook block into place at that angle, the locking bars 125 are inserted between the bracket surface 119*b* of respective brackets 119 and corresponding cross bars 124. The locking bars 125 can be locked in place with linchpins (not shown) similar to those disclosed with reference to FIG. 26. Note that the connection beams 112, 113 are pointing back up at an angle with the line of the assist crane.

FIG. 40 shows the partially-assembled hook block after the connection beams 112, 113 at the top of the sheave housing assemblies 902 are rotated to the side, toward the ground, in preparation for reeving where the boom top is to the side of the hook block 100. This is known as a resting position, and allows the connection links 106 and connection beams 112, 113 to be distanced from the wire rope 24 that will come in at an angle with respect to the sheaves 104. In this position, the stainless-steel pins 109 are removed from the sheave housings 102, and the hook block subassembly 100A is reeved.

Figure 41:
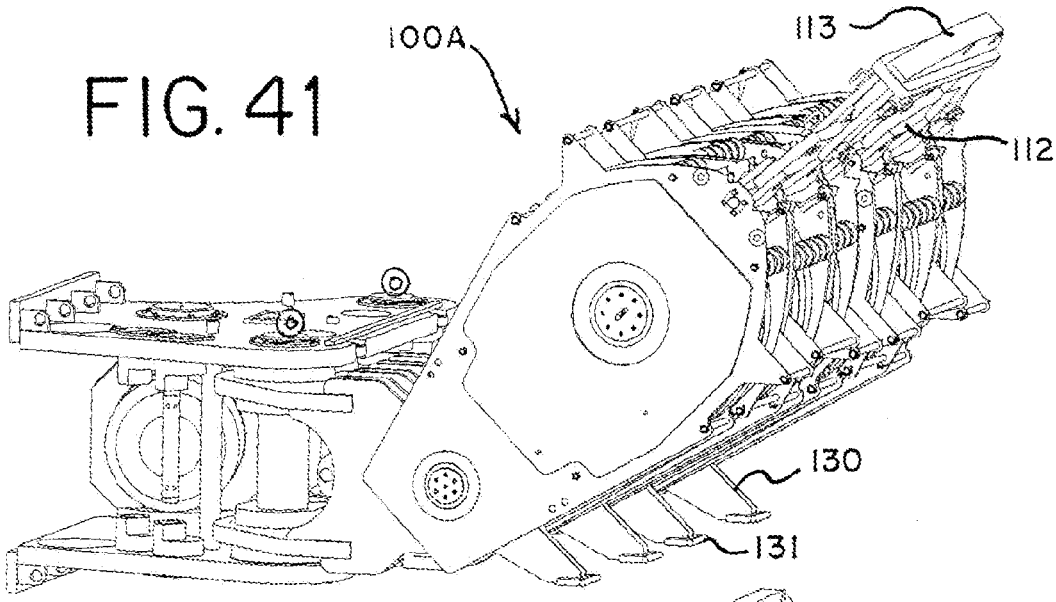
Figure 42:
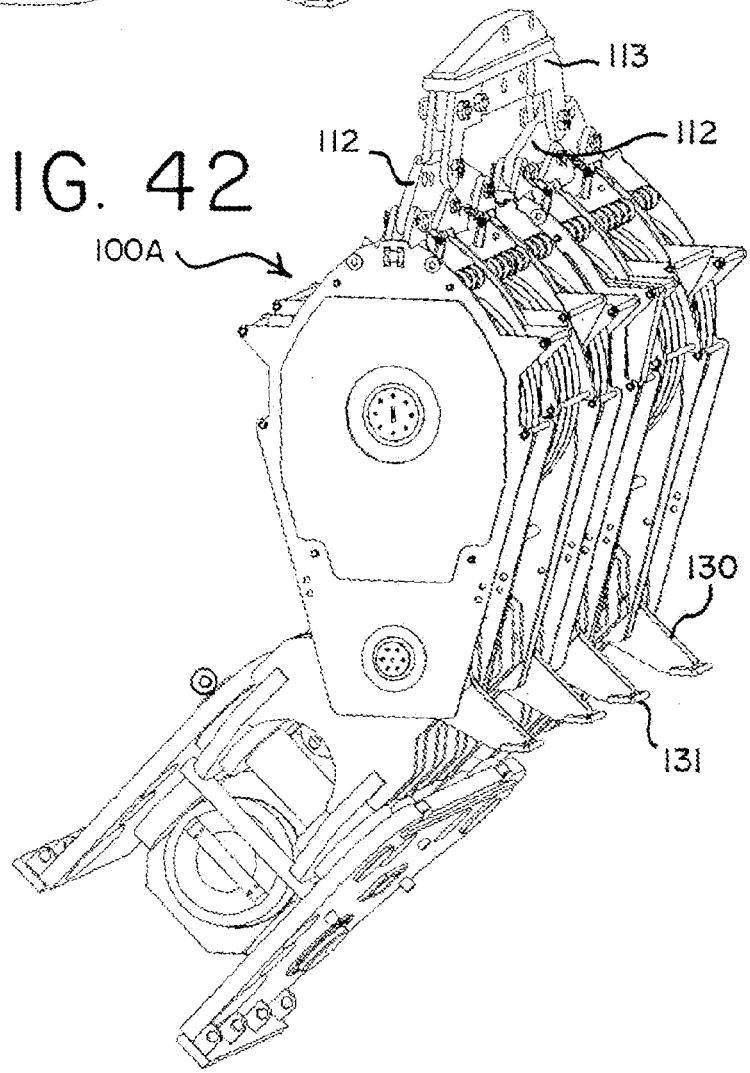

FIG. 41 shows the partially-assembled hook block of FIG. 40 after reeving, in which the connection beams 112, 113 have been rotated back up and the locking bars 125 removed. The wire rope lines are not shown for clarity. The partially-assembled, reeved hook block is now ready to be lifted by the crane 10. This should be done slowly, as shown in FIG. 42, and with care that the lifting lines of the wire rope 124 are running at the same speed, so that the hook block assemblies 100A remain horizontal. When the partially-assembled hook block is straight vertical, it should be set on the ground on the longitudinal rails 149 of the equalizer beam 140. The four crescent-shaped securing pins 142 are now removed while the lifting lines are tightened. The securing pins 142 are stored in their storage holes within the equalizer beam 140.

Figure 43:
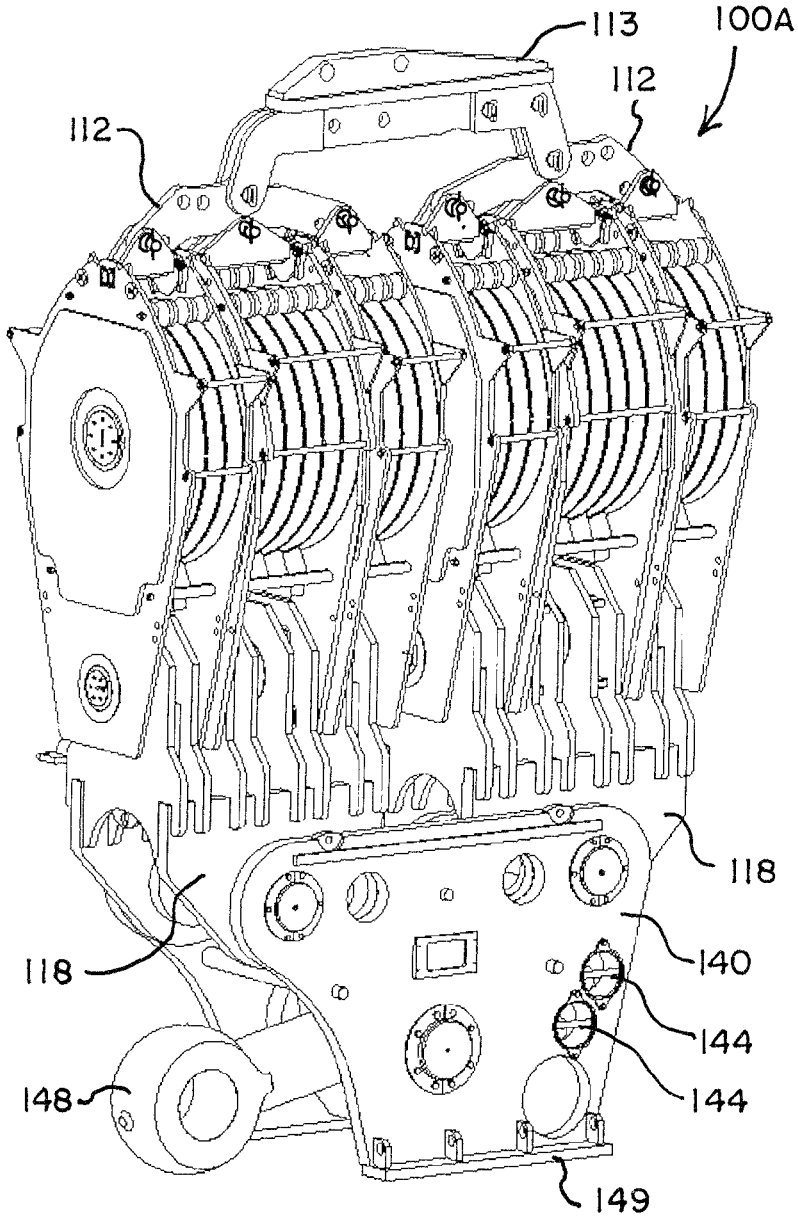
Figure 44:
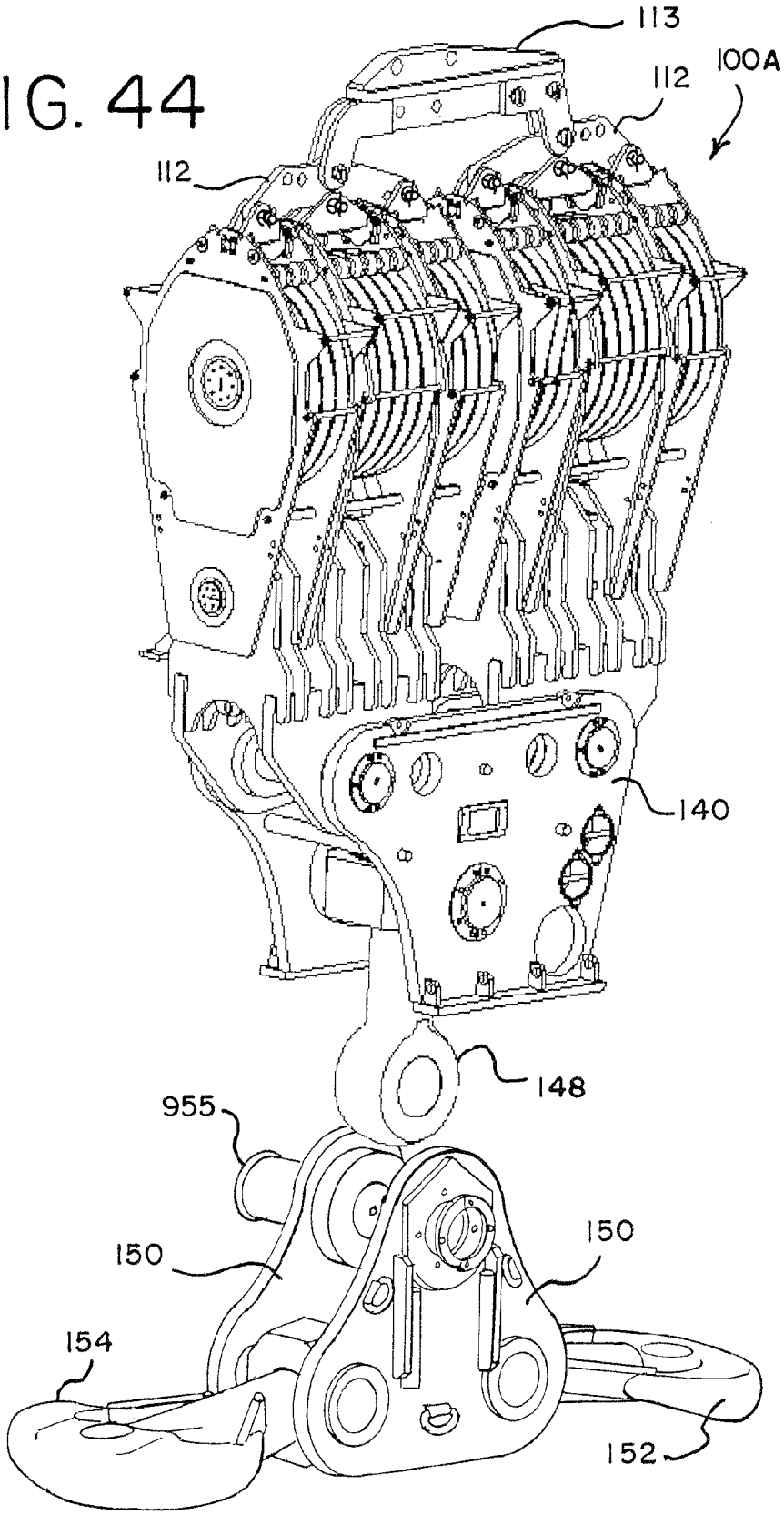
Figure 45:
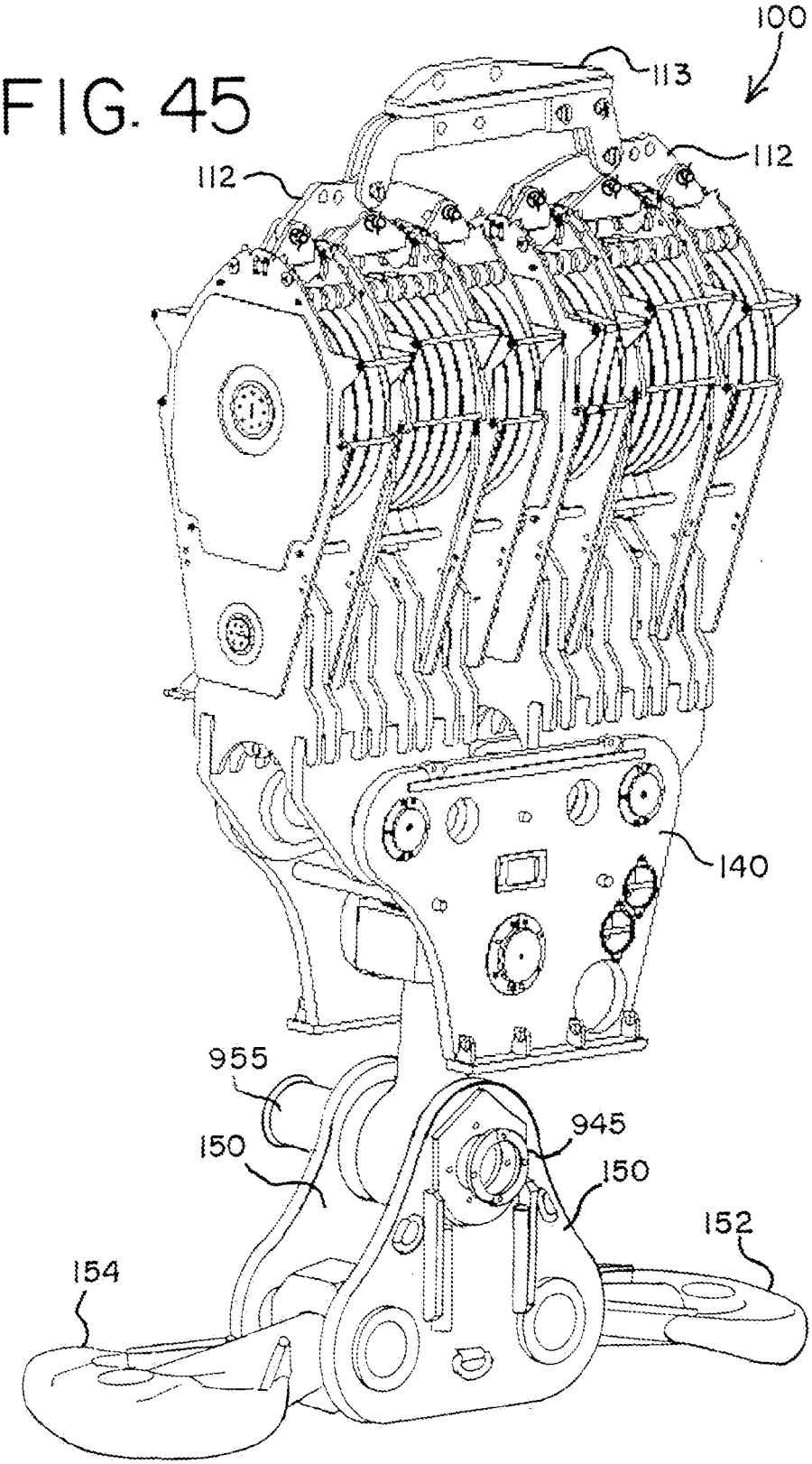
Figure 46:
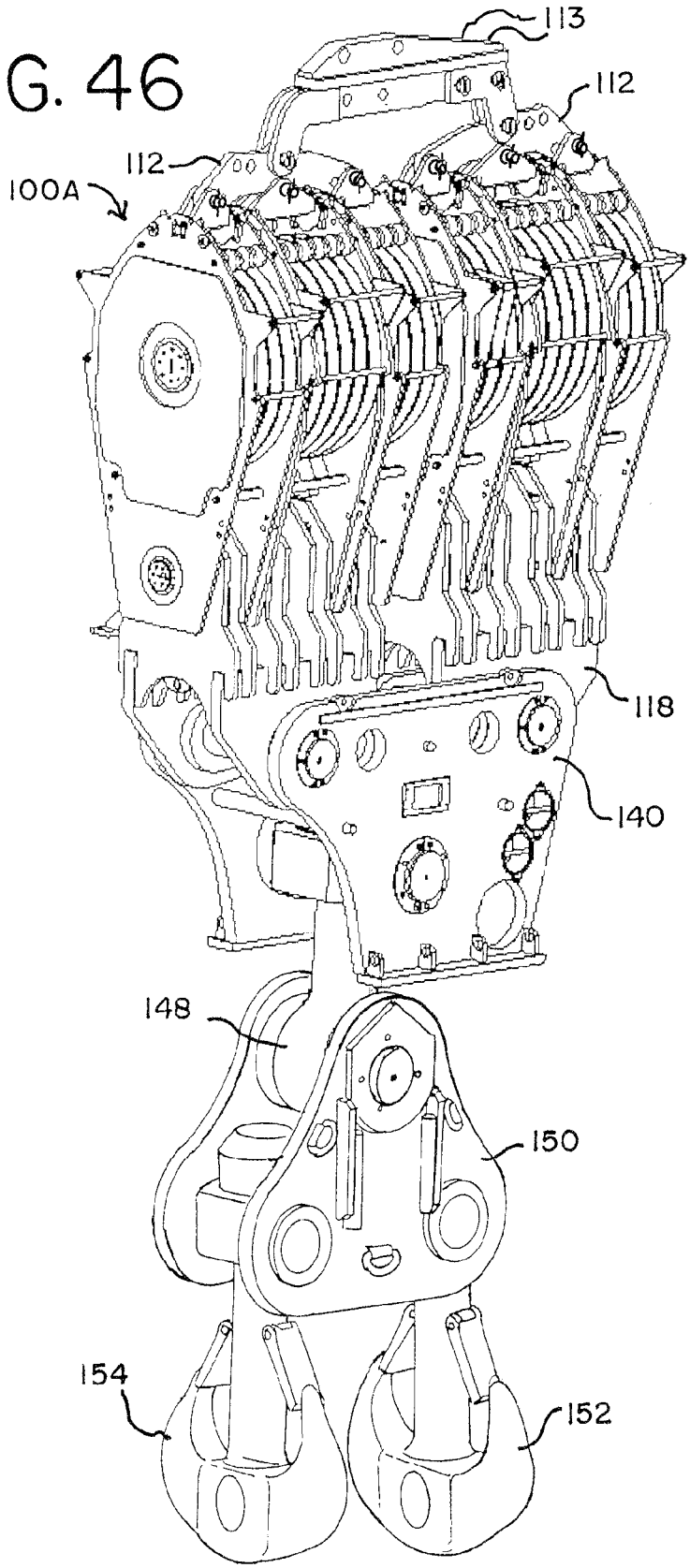

FIG. 43 shows the partially-assembled hook block in an upright position, the equalizer beam 140 standing on the ground after removal of the securing pins 142, the partially-assembled hook block ready to lifted into operation. FIG. 44 shows the partially-assembled hook block after being lifted into the air, wherein the main eye 148 of the equalizer beam 140 is rotatably connected to the hook suspension plates 150 that are lying on the ground. The hook suspensions 152, 154 pivotally connected to the hook suspension plates 150 are also lying on the ground. A long pin 955 similar to long pin 142 is inserted through the main eye 148 and through an aperture in the upper part of the hook suspension. A locking ring 945 is secured to the other end of the long pin 955, and bolted to hook suspension 150, as shown in FIG. 45. FIG. 46 shows the assembled hook block 100 of FIG. 2 after being assembled according to FIGS. 25 through 45, and lifted into the air by the crane 10, being ready for operation. Note that the methods described for assembling the hook block 100 may be similarly used to assemble hook blocks 200-600. Assembly of hook blocks 700 and 800 may be similar, but without use of the stabilizing feet 130. The lighter weight of hook blocks 700 and 800 and the fewer components make their assembly somewhat easier.

The order of the steps or actions of the methods described in connection with the disclosed embodiments may be changed as would be apparent to those skilled in the art. Thus, any order appearing in the Figures or described with reference to the Figures or in the Detailed Description is for illustrative purposes only and is not meant to imply a required order, except where explicitly required.

It should be understood that various changes and modifications to the presently preferred embodiments described herein will be apparent to those skilled in the art, some of which were already pointed out. Furthermore, components providing equivalent function may be substituted for various components in one of the hook blocks, even though different in structure. The placement or distance apart of the aligned holes of the equalizer and/or cross beams may differ to some degree and still function to provide for pivotal connections therebetween. Additional or fewer sheaves may be included in some of the sheave housings, and different combination of sheave housings may be employed. Such changes and modifications can be made without departing from the spirit and scope of the present embodiments and without diminishing its intended advantages. It is therefore intended that such changes and modifications be covered by the appended claims.

The invention claimed is:

1. A method of reeving a hook block for a crane wherein the hook block includes: a sheave housing containing a plurality of sheaves and having extended portions each with a hole therethrough, the sheave housing including a housing frame at a bottom thereof, the housing frame including a locking surface; a cross beam having multiple brackets each with a hole therethrough, at least one of the brackets having a plurality of surfaces corresponding to a plurality of angles of relative position between the sheave housing and the cross beam, where the plurality of surfaces correspond to the locking surface and form a gap therebetween at each of the plurality of angles; a shaft rotatably captured within the holes of the extended portions of the housing and of the multiple brackets of the cross beam; and a locking bar sized for placement in the gap between the locking surface and any of the plurality of surfaces at a respective one of the plurality of angles, the method comprising:

a) laying a lower portion of the hook block on the ground, the lower portion being connected to the cross beam;

b) angling the sheave housing to one of the plurality of angles of relative position;

c) inserting the locking bar between the locking surface and the surface of the at least one bracket corresponding to the angled relative position to substantially immobilize movement of the sheave housing relative to the cross beam; and d) reeving a wire rope of the crane through the plurality of sheaves of the sheave housing.

2. A method of reeving a hook block for a crane wherein the hook block includes: a sheave housing containing a plurality of sheaves and having extended portions each with a hole therethrough, the sheave housing including a housing frame at a bottom thereof, the housing frame including a locking surface; a cross beam having multiple brackets each with a hole therethrough, at least one of the brackets having a plurality of surfaces corresponding to a plurality of angles of relative position between the sheave housing and the cross beam, where the plurality of surfaces correspond to the locking surface and form a gap therebetween at each of the plurality of angles; a shaft rotatably captured within the holes of the extended portions of the housing and of the multiple brackets of the cross beam; a stabilizing foot rotatably connected with the shaft between two brackets, where the cross beam includes a stop between the two brackets to prevent rotation of the stabilizing foot beyond 90 degrees measured with respect to the cross beam, when vertical; and a locking bar sized for placement in the gap between the locking surface and any of the plurality of surfaces at a respective one of the plurality of angles, the method comprising:

a) laying a lower portion of the hook block on the ground, the lower portion being connected to the cross beam;

b) allowing a flat portion of the stabilizing foot to swing into contact with the ground on a side opposite the lower portion of the hook block;

c) setting the sheave housing on the ground as the weight thereof is stabilized between the lower portion of the hook block and the stabilizing foot;

d) inserting the locking bar between the locking surface and one of the plurality of surfaces of the at least one bracket to stabilize the sheave housing at one of the plurality of angles of relative position with respect to the cross beam; and e) reeving a wire rope of the crane through the plurality of sheaves of the sheave housing.

3. The method of claim 2, where the angles of relative position include at least zero, 45, and 90 degrees and, where placement of the locking bar within the gap associated with one of the angles of relative position substantially immobilizes the sheave housing and the cross beam at that angle.

4. The method of claim 2, where the flat portion of the stabilizing foot is located at one end and the stabilizing foot further includes, at an opposite end from the flat portion, a counterweight to provide a center of gravity such that the flat portion is positioned parallel relative to the surface of the ground while the cross beam is laid down horizontally.

5. The method of claim 2, where a connection link is pivotally connected to a top of the sheave housing and each of the plurality of sheaves includes a first groove about its circumference in which the wire rope is reeved, the method further comprising:

f) providing a plurality of deflection rollers rotatably attached to the housing adjacent the plurality of sheaves near the top of the sheave housing, each deflection roller including a second groove positioned on a plane of first grooves of each respective sheave; and g) passing the wire rope over the second grooves of the plurality of deflection rollers during reeving, the deflection rollers thus deflecting the wire rope away from the connection link.

6. A method of assembling a hook block for a crane, comprising:

a) providing a sheave housing containing a plurality of sheaves with a pivotal connection link secured to a top of the sheave housing, the sheave housing including extended portions each with a hole therethrough and a housing frame positioned below the plurality of sheaves, the housing frame having a locking surface;

b) placing a cross beam on its side with stabilizing feet, which move independently of the cross beam, resting on the ground such as to support the weight of the cross beam and the sheave housing;

c) positioning the extended portions of the sheave housing within a plurality of brackets of the cross beam, each bracket with a hole therethrough;

d) aligning the holes of the extended portions of the sheave housing with the holes of the brackets;

e) inserting a shaft through the holes of the extended portions of the sheave housing and the holes of the brackets;

f) securing a cap to an end of the shaft to resist lateral movement relative to the holes; and g) inserting a locking bar between the locking surface of the housing frame and a surface of a bracket of the cross beam, to resist relative movement between the sheave housing and the cross beam during further assembly.

7. The method of claim 6, wherein the cross beam comprises opposing plates each having two first apertures at a bottom thereof that are aligned with each other, the method further comprising:

h) placing an equalizer beam on the ground, the equalizer beam having opposing plates each having at least two second apertures along a top thereof that are aligned with each other and are located on a first side of the equalizer beam;

i) lifting the sheave housing with lifting equipment until the locking bar is removable; and j) removing the locking bar.

8. The method of claim 7, further comprising:

k) aligning at least a first set of the aligned first and the aligned second apertures of the opposing plates of the cross beam and the equalizer beam;

l) securing the cross beam to the equalizer beam with a long pin through the first set of the aligned first apertures and of the aligned second apertures;

m) inserting a securing pin into each of a second set of the aligned first apertures and of the aligned second apertures, one pin being inserted in each of the opposing plates of the equalizer and cross beams;

n) securing the securing pins to the equalizer beam to prevent motion of the cross beam relative to the equalizer beam; and o) reinserting the locking bar so that the lifting equipment may be removed.

9. The method of claim 8, wherein the second set of the first and second aligned apertures form a crescent-shaped aperture at each opposing plate of the equalizer and cross beams, and the securing pins are sized to fit into the crescent-shaped apertures.

10. The method of claim 8, wherein steps (a) through (o) are used to assemble a first subassembly for connection to the first side of the equalizer beam, wherein the equalizer beam includes at least two additional apertures along the top of each opposing plate that are aligned with each other, for connection to a second cross beam on a second side of the equalizer beam, the method further comprising:

repeating steps (a) through (o) to assemble a second subassembly including at least one sheave housing, a second shaft, and the second cross beam, which is connected to the second side of the equalizer beam.

11. The method of claim 10, further comprising:

p) connecting the connection link at the top of the sheave housing of the first subassembly to the connection link at the top of the sheave housing of the second subassembly with a connection beam;

q) lifting the hook block at the connection beam with lifting equipment;

r) removing the locking bar from the plurality of sheave housings; and s) reeving a wire rope through the plurality of sheaves of the plurality of sheave housings.

12. The method of claim 11, wherein reeving comprises:

a) laying the hook block down in a direction perpendicular to the equalizer beam plates until at least a pair of stabilizing feet, rotatably attached to the first and second shafts, rotate to contact the ground, thus stabilizing the first and second subassemblies between the stabilizing feet and the rest of the hook block;

b) angling the sheave housings to a desired angle with respect to the cross beam that is lying on the ground, wherein the sheaves in the sheave housings each include a first groove through which the wire rope is to be reeved; and c) inserting one or more locking bars between the locking surface of one or more of the sheave housings and an adjacent surface of one or more brackets of the cross beams, to immobilize relative movement between the sheave housings and the cross beams at the desired angle.

13. The method of claim 12, further comprising:

d) rotating the connection links and the connection beam toward the ground, to one side of the plurality of sheaves;

e) removing lift lines of the lifting equipment; and f) running the wire rope over a plurality of deflection rollers rotatably attached near the top of the sheave housings, to thus deflect the wire rope away from the connection links, each deflection roller including a second groove positioned on a plane of the first groove of each respective sheave.

14. The method of claim 13, wherein the sheave housing on each of the first and second sides comprises a plurality of sheave housings arranged side by side, the method further comprising:

t) connecting the connection links of the sheave housings on the first side with a first connection beam;

u) connecting the connection links of the sheave housings on the second side with a second connection beam; and v) connecting the first and second connection beams with a third connection beam, wherein lifting the hook blocks is done at the third connection beam.

15. The method of claims 13, wherein reeving further comprises:

begin lifting the hook block with the crane;

removing the locking bars;

finish lifting the hook block until the sheave housings are vertical and the equalizer beam is standing on the ground;

tightening lines of the wire rope that were reeved through the plurality of sheaves;

removing the securing pins; and lifting the hook block off the ground with the crane.

16. The method of claim 15, further comprising:

rotatably attaching hook suspension plates to a main eye, wherein the main eye is rotatably attached to the equalizer beam; and pivotally attaching at least one hook suspension to the hook suspension plates.

* * * * *